US008141703B2

(12) United States Patent
Sonoda et al.

(10) Patent No.: US 8,141,703 B2
(45) Date of Patent: Mar. 27, 2012

(54) INSTRUMENT HOUSING CASE

(75) Inventors: Jiro Sonoda, Shimada (JP); Takuji Kishita, Shimada (JP); Sumito Yamagishi, Shimada (JP)

(73) Assignee: Sakai Composites Corp., Shizuoka (JP)

( * ) Notice: Subject to any disclaimer, the term of this patent is extended or adjusted under 35 U.S.C. 154(b) by 0 days.

(21) Appl. No.: 12/764,209

(22) Filed: Apr. 21, 2010

(65) Prior Publication Data

US 2010/0270187 A1 Oct. 28, 2010

(30) Foreign Application Priority Data

Apr. 22, 2009 (JP) ..... 2009-103703

(51) Int. Cl.
*A45C 11/00* (2006.01)
*G01D 3/00* (2006.01)

(52) U.S. Cl. ..... 206/314; 206/14; 84/421

(58) Field of Classification Search ..... 206/314, 206/14, 204, 45.2, 45.23; 84/421, 267, 290, 84/452 R, 453; D3/201, 204
See application file for complete search history.

(56) References Cited

U.S. PATENT DOCUMENTS

| | | | | | |
|---|---|---|---|---|---|
| 208,409 | A * | 9/1878 | Menger | 206/14 |
| 239,617 | A * | 4/1881 | Monroe | 206/14 |
| 277,653 | A * | 5/1883 | Albert | 206/14 |
| 344,508 | A * | 6/1886 | Tuttle | 206/14 |
| 361,817 | A * | 4/1887 | Fiorini | 206/14 |
| 386,442 | A * | 7/1888 | Van Winkle | 206/14 |
| 2,803,982 | A * | 8/1957 | Gassin et al. | 84/275 |
| 4,147,254 | A * | 4/1979 | Bruce | 206/314 |
| 4,531,632 | A * | 7/1985 | Weber | 206/14 |
| 4,846,340 | A * | 7/1989 | Walther | 206/14 |
| 6,294,718 | B1 * | 9/2001 | Saunders et al. | 84/291 |
| 6,462,260 | B2 * | 10/2002 | Fediakov | 84/327 |
| 6,670,536 | B2 * | 12/2003 | Godin et al. | 84/453 |
| 6,866,146 | B2 * | 3/2005 | Heesch | 206/314 |
| 6,959,810 | B2 * | 11/2005 | Neilson | 206/314 |
| D564,031 | S * | 3/2008 | Perella et al. | D19/90 |

FOREIGN PATENT DOCUMENTS

JP 2006-220945 8/2006

* cited by examiner

*Primary Examiner* — J. Gregory Pickett
*Assistant Examiner* — Ernesto Grano
(74) *Attorney, Agent, or Firm* — Smith, Gambrell & Russell, LLP

(57) ABSTRACT

Provided is an instrument housing case, which allows an instrument to be readily taken in and out of the instrument. The instrument housing case (10) includes: a main body case (20), which has a bottomed cylindrical shape, and includes an opened upper end surface and opened upper portions of parts of side surfaces; and a cover body (30). The cover body (30) includes: a top plate (31) adapted for an opening portion (26) of the upper end surface of the main body case; and a side plate (33) adapted for an opening portion (28) of the parts of the side surfaces of the main body case (20), the side plate (33) including a lower end portion pivotably fixed to the main body case (20) through a hinge (40). The cover body (30) covers the opening portion (26) of the upper end surface and the opening portion (28) of the parts of the side surfaces of the main body case (20) to thereby allow the opening portions (26, 28) to open and close.

10 Claims, 15 Drawing Sheets

INSTRUMENT HOUSING CASE

BACKGROUND OF THE INVENTION

1. Field of the Invention

The present invention relates to an instrument housing case, which allows an instrument such as a violin or a cello to be readily taken in and out of the instrument housing case even in a limited space.

2. Description of the Related Art

Conventionally, various instruments are carried while being housed in a predetermined case. Among the instruments, stringed instruments, such as a violin and a cello, which are long in one direction, are generally housed in the following case.

That is, there has been widely used a case, which includes: a main body case having an longitudinal box shape, which extends along a longitudinal direction of the instrument; and a cover body, which is fixed to one side along a longitudinal direction of the case through hinges so as to be opened and closed. Further, by opening the cover body in a lateral direction with respect to the main body case, the main body case is opened so as to allow the instrument to be taken in and out of the case.

As the laterally-openable case described above, for example, Japanese Patent Application Laid-open No. 2006-220945 to be described below discloses a musical instrument storing case. Specifically, the musical instrument storing case is provided with: a main body case (box body) having a top opening; a covering body which covers the top opening; and a shock absorbing material which has a storing section having side walls that are formed to approximately match with a shape of side surfaces of a main body section of a musical instrument and is stored in the box body. The musical instrument storing case is further provided with a shock absorbing material moving system for causing a movable section, which is a part of the storing section side wall of the shock absorbing material, to move to an approaching direction with respect to the side surfaces of the main body section of the musical instrument, the movable section being movable to the approaching direction and a separating direction with respect to the side surfaces of the main body section of the musical instrument stored in the box body. Even in the musical instrument storing case, the musical instrument is taken in and out of the musical instrument storing case after the covering body is laterally opened with respect to the main body case.

However, in the instrument housing case in which the cover body is laterally opened with respect to the main body case, there are following problems. That is, when players take out of their instruments in a concert hall or the like, it is necessary to laterally open the cover body after the longitudinal main body case is disposed on an appropriate position. However, the concert hall or the like has a limited space for dealing with the instrument because of presence of the other players, their instruments, and the like. Therefore, it is difficult to ensure an appropriate space for disposing the main body case, and it is sometimes difficult to taken out of the instrument.

Further, the above-mentioned instrument housing case is generally provided with fasteners for retaining the cover body in a closed state with respect to the main body case. However, there is risk in that, in a case where the instrument housing case is lifted up in a state in which the fasteners are left unlocked, or in a case where the fasteners are forced to be unlocked during conveyance, the cover body is widely and laterally opened with respect to the main body case with a result in which the instrument falls out of the main body case.

In addition, the above-mentioned instrument housing case has a structure in which the cover body is widely and laterally opened with respect to the main body case and is closed with respect to the main body case in such a manner that a limb portion of the cover body comes into contact with a limb of an opening portion of the main body case. However, it is relatively difficult for peripheral wall portions, which are opened and closed and come into contact with each other, to ensure their stiffness, and hence those portions need often to be increased in wall thickness. That leads to an increase in weight of the instrument housing case.

SUMMARY OF THE INVENTION

Therefore, it is an object of the present invention to provide an instrument housing case, which allows an instrument to be readily taken in and out of the instrument housing case even in a limited space, and which is capable of preventing the instrument from falling down, and is further capable of achieving a reduction in weight.

In order to achieve the above-mentioned object, there is provided an instrument housing case for housing an instrument, which is long in one direction, the instrument housing case allowing the instrument to be taken in and out of the instrument housing case in a state in which the instrument housing case is placed while a longitudinal direction of the instrument housing case is oriented in a vertical direction, the instrument housing case including: a main body case, which has a bottomed cylindrical shape, and includes an opened upper end surface and opened upper portions of parts of side surfaces; and a cover body, including: a top plate adapted for an opening portion of the upper end surface of the main body case; and a side plate adapted for an opening portion of the parts of the side surfaces of the main body case, the side plate including a lower end portion pivotably fixed to the main body case through a hinge, the cover body covering the opening portion of the upper end surface and the opening portion of the parts of the side surfaces of the main body case to thereby allow the opening portions to open and close.

According to the above-mentioned invention, there is provided the instrument housing case for housing the instrument, which is long in one direction, the instrument housing case allowing the instrument to be taken in and out of the instrument housing case in the state in which the instrument housing case is placed while the longitudinal direction of the instrument housing case is oriented in the vertical direction with respect to a placement surface. Thus, it is possible to take the instrument in and out of the instrument housing case without requiring a user to take a difficult position even in a place having a limited space for dealing with the instrument, such as a concert hall.

Further, it is possible to decrease in risk in that the instrument falls out of the instrument housing case even in a case where the instrument housing case is lifted up in a state in which fasteners, which are provided between the main body case and the cover body, are left unlocked, or even in a case where the fasteners are forced to be unlocked due to external force during conveyance.

In addition, the main body case forms a cylindrical shape in a part below the opening portions thereof. Thus, it is possible to increase the strength and stiffness of the main body case, and sufficient strength can be obtained even when the main body case is decreased in wall thickness and the like. Therefore, it is possible to reduce the weight of the instrument housing case.

It is preferred that the instrument housing case according to the present invention have a structure in which, when the cover body is opened by downwardly pivoting the cover body, a bottom portion of the main body case and the top plate of the cover body be positioned so as to be substantially flush with each other, to thereby allow the bottom portion of the main body case and the top plate of the cover body to be seated and placed. In this aspect, when the cover body is opened by downwardly pivoting the cover body, the bottom portion of the main body case and the top plate of the cover body are positioned so as to be substantially flush with each other, to thereby allow the bottom portion of the main body case and the top plate of the cover body to be seated and placed. Thus, upon taking the instrument in and out of the instrument housing case, it is possible to stably support the instrument housing case.

It is preferred that, in the instrument housing case according to the present invention, when viewed from the opening portion of the parts of the side surfaces, a fitting line formed between the cover body and the main body case form a shape being downwardly narrower, the horizontal width linking between both sides of the fitting line being downwardly narrower. In this aspect, the fitting line formed between the cover body and the main body case is set so as to form the shape being downwardly narrower, while the horizontal width linking between both sides of the fitting line being downwardly narrower. Thus, it is possible to increase the stiffness of the main body case as possible. Further, it is possible to increase the strength of a fixing portion for a grip handle upon fixing, in the substantially center in the longitudinal direction of the main body case, the grip handle to be gripped for carrying the instrument housing case in a laid posture.

It is preferred that, in the instrument housing case according to the present invention, the main body case form a shape, in which a pair of opposed surfaces have larger widths, and a pair of opposed surfaces, which are orthogonal to the pair of opposed surfaces having the larger widths, have smaller widths, and that the opening portion of the parts of the side surfaces be formed over one surface of the pair of opposed surfaces having the larger widths and over both surfaces of the pair of the opposed surfaces having the smaller widths, which are adjacent to the one surface having the larger widths. In this aspect, it is possible to increase an opening width formed of the both opening portions as possible without deteriorating the stiffness of the main body case, to thereby readily take the instrument in and out of the instrument housing case. Further, the side plate of the cover body forms a shape in which the opening portion of the upper end surface of the main body case, the opening portion which is formed in the larger-width-surface of the main body case, and the opening portion which is formed in the both side surfaces adjacent to the larger-width-surface are all covered. Thus, it is possible to increase the stiffness of the cover body.

It is preferred that, in the instrument housing case according to the present invention, both side portions of the opposed surfaces having the larger widths of the main body case be connected to each other through dividing walls, and that a housing portion for housing an accessory of the instrument be formed in each side portion of an inside of the main body case. In this aspect, when the instrument housing case according to the present invention is applied to the rubbed string instrument, for example, it is possible to house the accessory such as a bow in the housing portion. Further, it is possible to increase the stiffness of the main body case due to the dividing walls.

It is preferred that the instrument housing case according to the present invention further include: a grip handle to be gripped for carrying the instrument housing case in a laid posture, the grip handle being fixed in a center portion of a side surface of the main body case; and a shoulder strap for carrying the main body case on a back of a user thereof in a state in which the longitudinal direction of the main body case is oriented in the vertical direction, the shoulder strap being fixed at an upper part and a lower part of the main body case or being fixed at a lower part of the main body case and an upper part of the cover body. In this aspect, it is possible not only to carry the instrument housing case in the laid posture while gripping the grip handle of the main body case, but also to retain the instrument housing case remaining arranged in the upright posture by slinging the shoulder strap over the shoulder of a user. Further, when the instrument housing case remaining arranged in the upright posture is retained, the top plate of the cover body is upwardly oriented, and hence it is possible to prevent rain water and the like from readily getting into the instrument housing case.

It is preferred that the instrument housing case according to the present invention be formed of a resin reinforced with woven fabric containing carbon fiber. In this aspect, it is possible to provide the instrument housing case having light weight and high stiffness.

It is preferred that, in the instrument housing case according to the present invention, the instrument include a rubbed string instrument including: a main body portion; a neck extending from the main body portion; a bridge portion arranged on a front side of the main body portion; a string tensioned through the bridge portion on the front side of the main body portion and on a front side of the neck; and a chinrest fixed with an end pin to an end portion of the main body portion on a side opposite to the neck, that a first retaining portion for supporting a vicinity of the end pin be provided on an inner surface of the bottom portion of the main body case, that a second retaining portion for sandwiching the neck be provided on an inner surface of the main body case, which is opposed to the side plate of the cover body, and on an inner surface of the side plate of the cover body, and that an area in which a painted surface of the instrument is held in contact with an inner surface of the instrument housing case be set to be 10% or less of an entire of the painted surface. In this aspect, the instrument is retained by the first retaining portion for supporting the vicinity of the end pin and the second retaining portion for sandwiching the neck. Thus, the painted surface of the instrument is held without or in less contact with the inner surface of the instrument housing case as possible. As a result, it is possible to prevent the painted surface from being damaged and from having marks generated due to adhesion of a cushion member.

It is preferred that, in the instrument housing case according to the present invention, the second retaining portion include: a first holding member, which is fixed on the inner surface of the side plate of the cover body, and holds a back surface portion of the neck; and a second holding member, which is fixed on the inner surface of the main body case, and with which a fingerboard provided on the front side of the neck comes into contact, and that the fingerboard be supported in substantially parallel to the inner surface of the main body case. In this aspect, the back surface portion (not painted portion) of the neck is held by the first holding member and the fingerboard (portion formed of material resistant to damages and marks) is held by the second holding member. Thus, it is possible to retain the instrument in a state in which the painted surface thereof is not held in contact with any part. Further, the fingerboard is supported in substantially parallel to the inner surface of the main body case, and hence it is possible to efficiently house the rubbed string instrument in the instrument housing case due to a decrease in an unnecessary space, and to retain more stably the instrument in the instrument housing case.

In addition, the back surface portion of the neck of the instrument is held by the first holding member and the fingerboard on the front side of the neck comes into contact with the second holding member. Thus, a front side of strings, which are tensioned on the front side of the neck, comes into contact with the second holding member elastically. Therefore, even when impacts and oscillation act from an outside of the instrument housing case, those impacts and oscillation are absorbed due to elastic force of the strings held in contact with the second holding member. Thus, it is possible to suppress unfavorable effects provided to the instrument.

It is preferred that, in the instrument housing case according to the present invention, between the first retaining portion and the second retaining portion in the inner surface of the main body case, which is opposed to the side plate of the cover body, a recessed portion for arranging the bridge portion of the rubbed string instrument while preventing the bridge portion from coming into contact with the inner surface of the instrument housing case be formed. In this aspect, the recessed portion for arranging the bridge portion of the rubbed string instrument while preventing the bridge portion from coming into contact with the inner surface of the instrument housing case is formed between the first retaining portion and the second retaining portion. Thus, when the rubbed string instrument is taken in and out of the instrument housing case, the bridge portion is not allowed to readily come into contact with the inner surface of the instrument housing case. Further, when the instrument is housed in the instrument housing case, it is possible to prevent the bridge portion from coming into contact with the inner surface of the instrument housing case, to thereby effectively protect the bridge portion.

It is preferred that, in the instrument housing case according to the present invention, in the inner surface of the main body case, which is opposed to the side plate of the cover body, an inclined surface be formed above the first retaining portion, the inclined surface protruding toward the inside of the main body case as extending toward a lower side of the main body case, so as to reach the first retaining portion. In this aspect, when the rubbed string instrument is housed in the instrument housing case so that a side of the end pin is first inserted therein, the end pin of the rubbed string instrument is guided by the inclined surface, and moves gradually into the instrument housing case. Then, the thin neck, which extends from the main body portion, is arranged substantially along the inner surface of the main body case. At the same time, the end pin is lifted up toward the inside of the instrument housing case with respect to the neck. Thus, in the above-mentioned state, it is possible to house and retain the rubbed string instrument in a balanced and stable posture in the instrument housing case.

It is preferred that, in the instrument housing case according to the present invention, the first holding member be structured so as to come into contact with an edge portion, which is on a side opposite to the end pin of the main body portion of the instrument, from a side of a back surface of the instrument when the cover body is closed, to thereby hold the main body portion against the first retaining portion. In this aspect, the vicinity of the end pin of the main body portion of the instrument is supported by the first retaining portion, and the edge portion on the side opposite to the end pin is held and retained by the first holding member against the first retaining portion. Therefore, the both ends of the main body portion of the instrument are securely supported, and it is possible to more stably retain the instrument in the instrument housing case.

It is preferred that, in the instrument housing case according to the present invention, bow-retaining portions be provided on both sides of the inner surface of the main body case, which is opposed to the side plate of the cover body, that each of the bow-retaining portions include: a guide wall portion for regulating both side positions of a bow; and a fixture for detachably fixing the bow to the inner surface, and that at least one of the guide wall portions include a cavity therein so as to house components therein. In this aspect, the bow can be retained in the bow-retaining portion. Further, it is possible to house components such as the bow in the cavity in the inside of the guide wall portion, and hence it is possible to increase a convenience for a user of the instrument housing case.

It is preferred that, in the instrument housing case according to the present invention, protection layers formed of an elastic resin be formed at least in corner portions of the bottom portion of the main body case. In this aspect, when impact force is applied on the instrument housing case, due to falling of the instrument housing case, for example, it is possible to alleviate the impact force so as to prevent the instrument housing case from being damaged.

It is preferred that, in the instrument housing case according to the present invention, the fitting line between the cover body and the main body case form a shape in which the fitting line extends downwardly from the upper end surface of the main body case along the both surfaces of the pair of the opposed surfaces having the smaller widths, and then, extends across a center portion of the one surface of the pair of opposed surfaces having the larger widths. In this aspect, the fitting line forms the shape in which the fitting line extends downwardly from the upper end surface of the main body case along the both surfaces of the pair of the opposed surfaces having the smaller widths, and then, extends across the center portion of the one surface of the pair of opposed surfaces having the larger widths. Thus, it is possible to ensure the opening area of the opening portions by the maximum degree when the cover body is opened from the main body case. Thus, it is possible to smoothly take the instrument in and out of the instrument housing case.

It is preferred that, in the instrument housing case according to the present invention, the main body case form a shape in which both side corner portions of a wall portion opposed to the side plate of the cover body are chamfered when viewed from a side of the upper end surface and a side of a lower end surface of the main body case. In this aspect, the both side corner portions of the wall portion of the main body case are chamfered, the wall portion being opposed to the side plate of the cover body. Thus, the entire main body case is formed so as to be thinner and slimmer. In this way, it is possible to further reduce the weight and size of the instrument housing case.

According to the present invention, there is provided an instrument housing case for housing an instrument, which is long in one direction, the instrument housing case allowing the instrument to be taken in and out of the instrument housing case in a state in which the instrument housing case is placed while a longitudinal direction of the instrument housing case is oriented in a vertical direction with respect to a placement surface. Thus, it is possible to take the instrument in and out of the instrument housing case without requiring a user to take a difficult position even in a place having a limited space for dealing with the instrument, such as a concert hall.

Further, it is possible to decrease in risk in that the instrument falls out of the instrument housing case even in a case where the instrument housing case is lifted up in a state in which fasteners, which are provided between the main body case and the cover body, are left unlocked, or even in a case where the fasteners are forced to be unlocked due to external force during conveyance.

In addition, the main body case forms a cylindrical shape in a part below the opening portions thereof. Thus, it is possible to increase the strength and stiffness of the main body case, and sufficient strength can be obtained even when the main body case is decreased in wall thickness and the like. Therefore, it is possible to reduce the weight of the instrument housing case.

BRIEF DESCRIPTION OF THE DRAWINGS

In the accompanying drawings:

FIG. 10 illustrate an instrument housing case according to another embodiment of the present invention, in which

DETAILED DESCRIPTION OF THE PREFERRED EMBODIMENTS

Hereinafter, with reference to the drawings, an instrument housing case according to one embodiment of the present invention is described.

Figure 1:
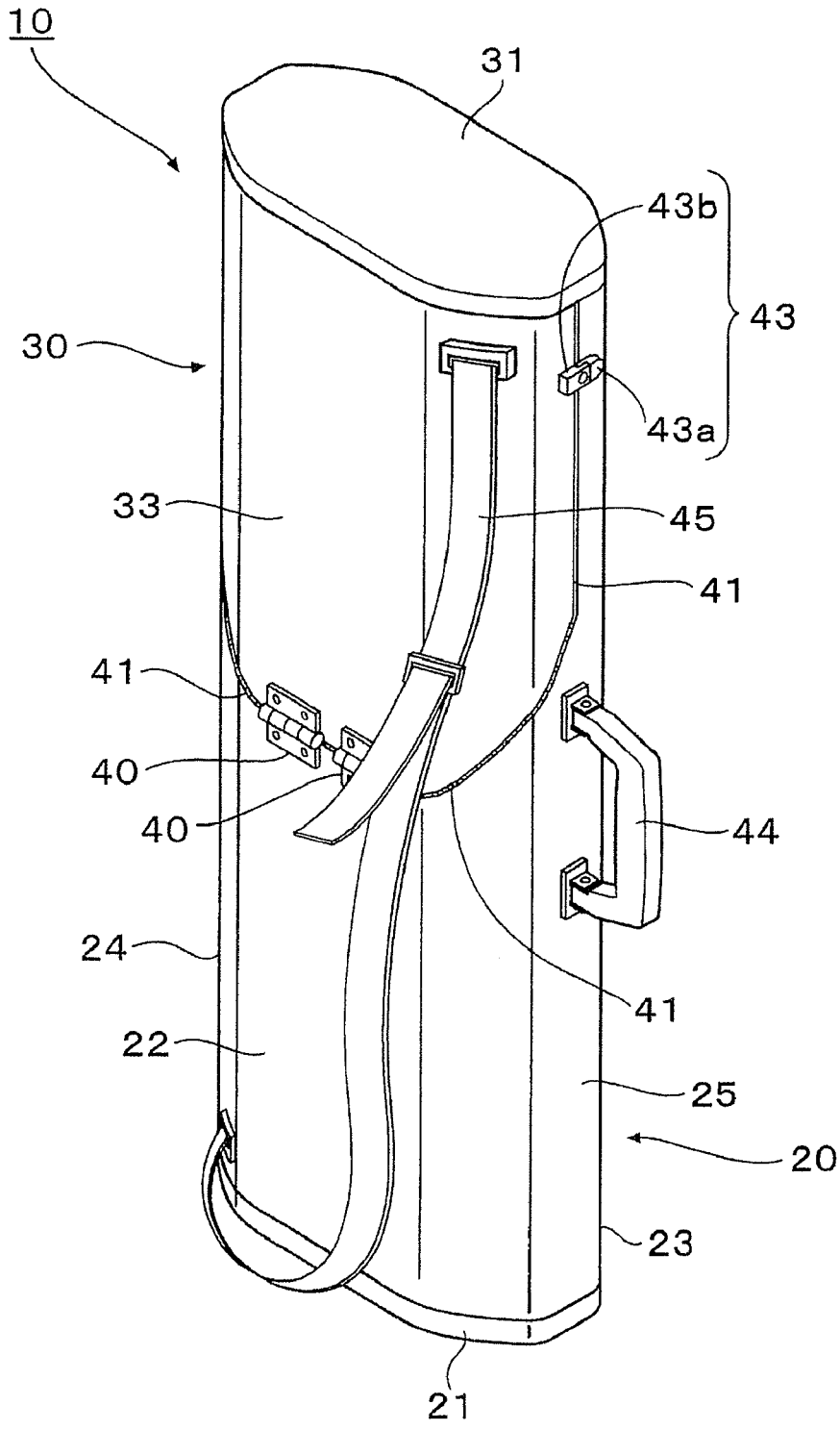
FIG. 1 is a perspective view illustrating an instrument housing case according to one embodiment of the present invention.
Figure 2:
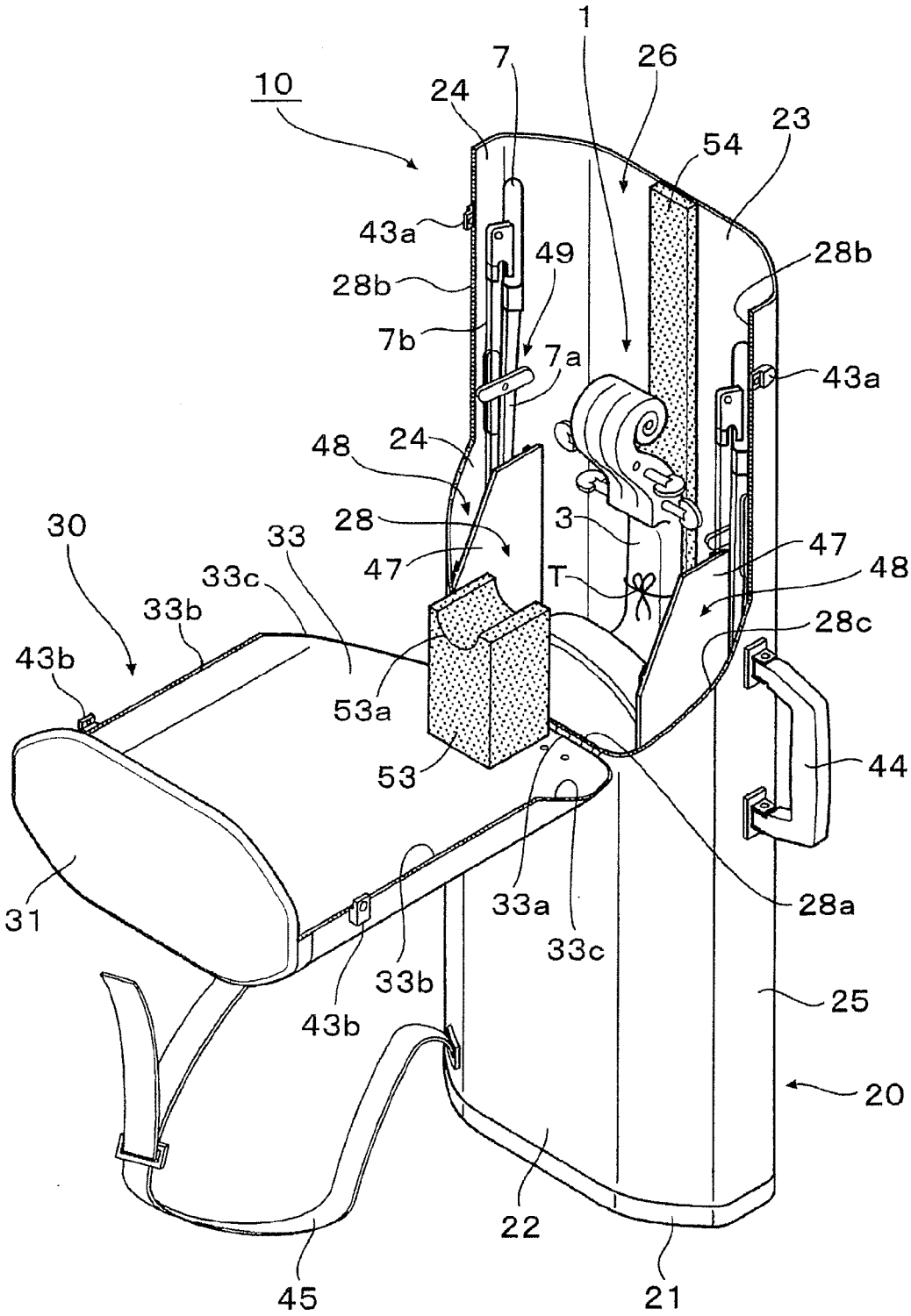
FIG. 2 is a perspective view illustrating a state in which opening portions are semi-opened by downwardly pivoting a cover body by approximately 90° in the instrument housing case according to the embodiment of the present invention.
Figure 3:
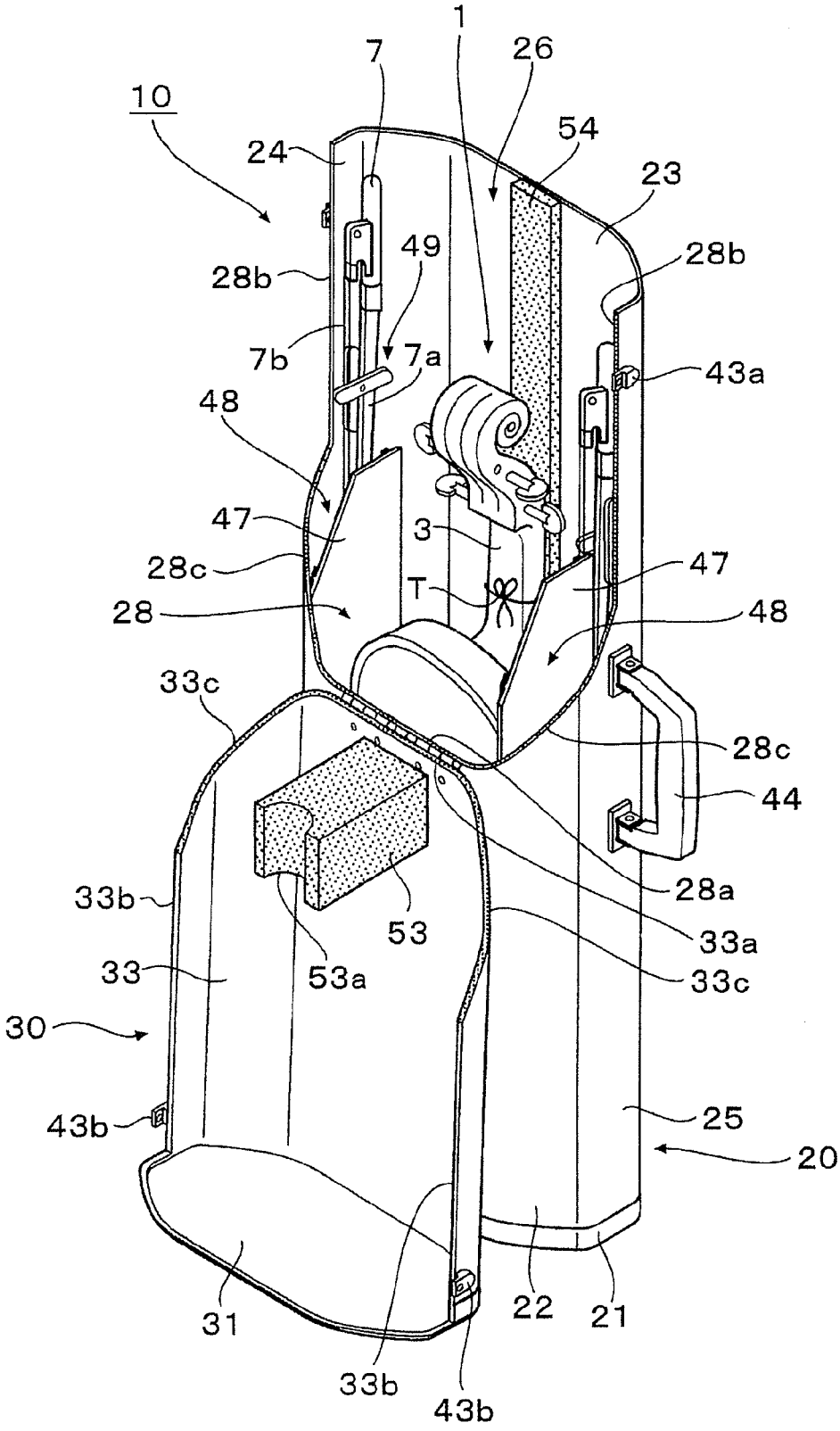
FIG. 3 is a perspective view illustrating a state in which the opening portions are completely opened by downwardly pivoting the cover body by approximately 180° in the instrument housing case according to the embodiment of the present invention.

The instrument housing case houses an instrument which is long in one direction. The instrument housing case allows the instrument to be taken in and out of the instrument housing case in a state in which the instrument housing case is placed while its longitudinal direction is oriented in a vertical direction with respect to a placement surface. As illustrated in FIG. 1 to FIG. 3, the instrument housing case 10 includes a main body case 20 and a cover body 30. The main body case 20 has a bottomed cylindrical shape, and includes an opened upper end surface and opened upper portions of parts of side surfaces. The cover body 30 is pivotably fixed to the main body case 20 through hinges 40, and covers an opening portion of the upper end surface and an opening portion of the parts of the side surfaces of the main body case 20 to thereby allow the opening portions to open and close. Note that, in the foregoing description, the "upper and lower direction" means a direction in a state in which a bottom portion 21 of the main body case 20 is disposed on the placement surface and the main body case 20 is erected in the longitudinal direction thereof (disposed in an upright posture) as illustrated in FIG. 1 to FIG. 4.

Figure 8:
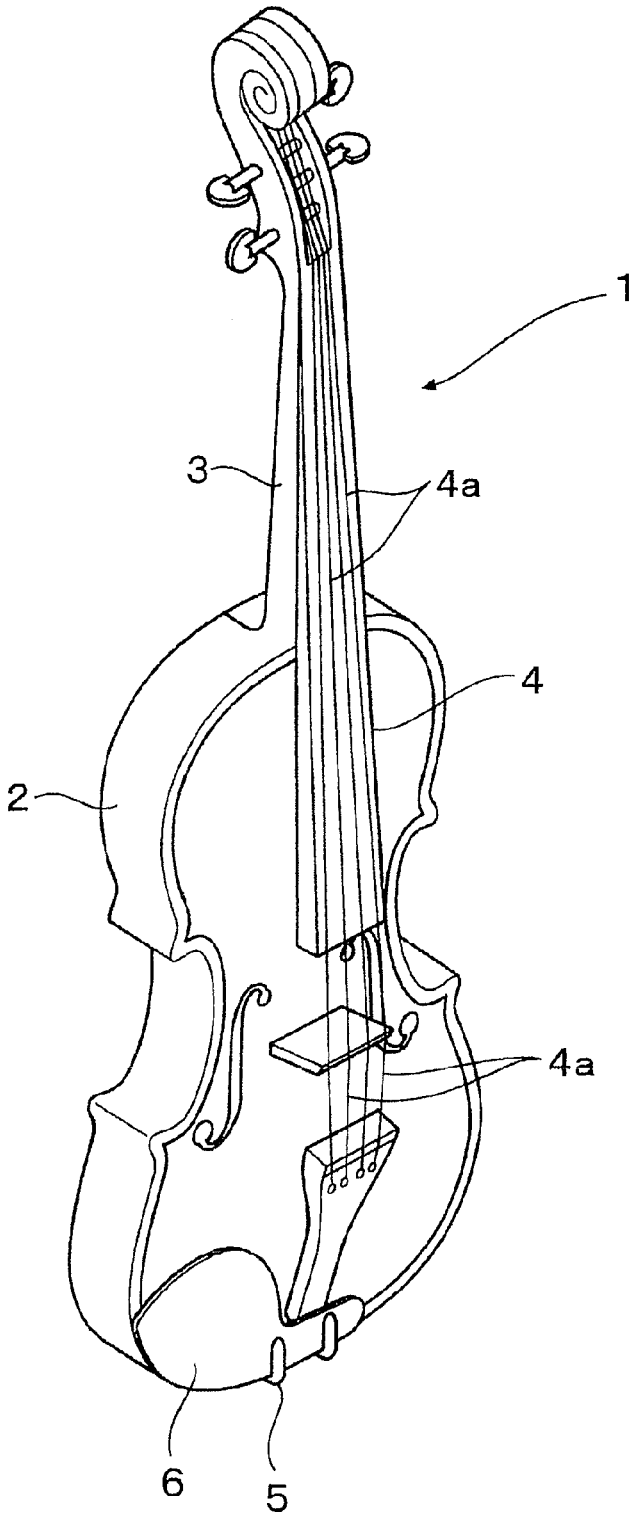
FIG.8 PRIOR ART
FIG. 8 is a perspective view illustrating one example of an instrument to be housed in the instrument housing case according to the embodiment of the present invention.

Further, as the instrument, which is long in one direction, which is housed by the instrument housing case 10, for example, there are exemplified a so-called rubbed string instrument such as a violin, a cello, and a contrabass, and a so-called plucked string instrument such as a guitar, a koto (long Japanese zither with thirteen strings), and a biwa (four-stringed Japanese lute). Of those instruments, a rubbed string instrument as illustrated in FIG. 8 is preferred. Specifically, such a rubbed string instrument includes: a main body portion 2; a neck 3 extending from one side in a longitudinal direction of the main body portion 2; a fingerboard 4 provided by a predetermined length over a front surface side of the neck 3 and a front surface side of the main body portion 2; a bridge portion 8 fixed in a substantially center on the front surface side of the main body portion 2; a plurality of strings 4*a* supported by the bridge portion 8 and tensioned along a longitudinal direction of the fingerboard 4; and a chinrest 6 fixed through end pins 5 to an end portion of the main body portion 2, on a side opposite to the neck 3. An instrument 1 as the rubbed string instrument includes bows 7 (see FIG. 2, FIG. 3, and FIG. 5). Each of the bows 7 includes: a stick 7*a*; and a bow hair 7*b* tensioned along a longitudinal direction of the stick 7*a* in parallel to the stick 7*a*.

The main body case 20 includes the bottom portion 21, a pair of larger-width-walls 22 and 23 on a front side and a rear side, and a pair of smaller-width-walls 24 and 25 on a right side and a left side. The bottom portion 21 forms a laterally long plate shape long in one direction, and four corners of the bottom portion 21 are chamfered so as to be shaped into a laterally long octagonal shape. The pair of larger-width-walls 22 and 23 are provided upright from limbs of both sides (larger sides) along a longitudinal direction of the bottom portion 21. The pair of smaller-width-walls 24 and 25 are provided upright from limbs of both sides (smaller sides) orthogonal to the longitudinal direction of the bottom portion 21, and are arranged so as to be orthogonal to the pair of larger-width-walls 22 and 23. Both side portions in a width direction of the pair of larger-width-walls 22 and 23 form a shape obliquely folded toward the smaller-width-walls 24 and 25 correspondingly to a shape of the bottom portion 21 (see FIG. 2 and FIG. 3). The above-mentioned larger-width-walls 22 and 23 and smaller-width-walls 24 and 25 constitute side surfaces in the present invention. Further, in the embodiment described hereinafter, an inner surface of one larger-width-wall 23 of the main body case 20 means "an inner surface of the main body case, which is opposed to a side plate of the cover body," in the present invention.

In the upper end surface of the main body case 20 in the above-mentioned structure, there is formed an opening portion 26 of the upper end surface. The opening portion 26 of the upper end surface forms a shape adapted for a top plate 31 of the cover body 30 described later. In addition, the other larger-width-wall 22 and the pair of smaller-width-walls 24 and 25 in the right and left direction are cut out into a predetermined shape, and the parts of the side surfaces of the main body case 20 are opened. In this way, an opening portion 28 of the parts of the side surfaces is formed. The opening portion 28 of the parts of the side surfaces forms a shape adapted for a side plate 33 of the cover body 30 described later.

That is, as illustrated in FIG. 2 and FIG. 3, an upper end surface 28*a* in a center in a width direction of the larger-width-wall 22 on a side of a front surface (in other words, lower end edge of the opening portion 28 of the parts of the side surfaces) is formed in a substantially center portion in a height of the main body case 20 in parallel to the bottom portion 21. Further, upper portions of the pair of smaller-width-walls 24 and 25 are set to have a half plate width of the lower portions, and form a half-cut shape adapted for the side plate 33 of the cover body 30. Inner end surfaces 28*b* and 28*b* of the upper portions of the pair of smaller-width-walls 24 and 25 are formed along a longitudinal direction thereof in parallel to each other. In addition, both ends of the upper end surface 28*a* and lower ends of the inner end surfaces 28*b* and 28*b* are connected to each other through oblique end surfaces 28*c* and 28*c*, respectively. The oblique end surfaces 28*c* and 28*c* are obliquely formed so as to make an opening width of the opening portion 28 of the parts of the side surfaces gradually narrower toward the bottom portion 21. Each of the oblique end surfaces 28*c* is formed over the larger-width-wall 22 and both the smaller-width-walls 24 and 25. Further, an inner portion of the main body case 20, which is surrounded by the upper end surface 28*a*, the inner end surfaces 28*b* and 28*b*, and the oblique end surfaces 28*c* and 28*c*, forms the opening portion 28 of the parts of the side surfaces in the present invention.

As described above, with regard to the main body case 20 in this embodiment, a pair of opposed surfaces (larger-width-walls 22 and 23) have larger widths, and opposed surfaces (smaller-width-walls 24 and 25), which are orthogonal to the pair of opposed surfaces, have smaller widths. In this way, the main body case 20 forms a generally flat shape. Further, the opening portion 28 of the parts of the side surfaces is formed over one surface having a larger width (larger-width-wall 22) and over both side surfaces (smaller-width-walls 24 and 25), which are adjacent to the surface having the larger width. Here, having a generally flat shape means having a flat shape long in one direction in a plan view. For example, the flat shape means a structure in which the bottom portion is shaped into a laterally long rectangular shape or an ellipse shape having a larger diameter and a smaller diameter and the larger-width-walls and the smaller-width-walls are provided correspondingly to the shape of the bottom portion so as to extend from the bottom portion over a long distance.

Meanwhile, the cover body 30 in this embodiment includes the top plate 31 and the side plate 33. The top plate 31 is adapted for the opening portion 26 of the upper end surface of the main body case 20. The side plate 33 forms a half-cut shape so as to be adapted for the opening portion 28 of the parts of the side surfaces of the main body case 20. The top plate 31 forms the laterally long octagonal shape identical to the shape of the bottom portion 21 of the main body case 20. The side plate 33 is provided so as to extend from a long side and parts of limbs of both short sides adjacent to the long side of the top plate 31 (see FIG. 3), the parts extending from the long side up to center portions of the limbs. Further, as illustrated in FIG. 1, when both the opening portions 26 and 28 of the main body case 20 are closed by upwardly pivoting the cover body 30, a front portion of the side plate 33 is formed so as to be flush with respect to the larger-width-wall 22 of the main body case 20 in such a manner that the front portion of the side plate 33 and the side wall 22 form a smooth surface without steps. Both side portions of the side plate 33 are formed so as to be flush with respect to the both smaller-width-walls 24 and 25 on right and left sides in such a manner that the side portions of the side plate 33 and the smaller-width-walls 24 and 25 form smooth surfaces without steps.

A lower end surface 33*a* in a center in a width direction of the side plate 33 is formed in parallel to the top plate 31. Inner end surfaces 33*b* and 33*b* on both sides of the side plate 33 are formed along the longitudinal direction thereof in parallel to each other. In addition, both ends of the lower end surface 33*a* and the inner end surfaces 33*b* and 33*b* are connected through oblique end surfaces 33*c*, respectively. Further, as illustrated in FIG. 1, the two hinges 40 and 40 are fixedly provided at a predetermined interval in a limb of the upper end surface 28*a* on the side of the front surface of the larger-width-wall 22 and in a limb of the lower end surface 33*a* on the side of the front surface of the side plate 33. As a result, the cover body 30 can be fixed with respect to the main body case 20 so as to be pivotable in the upper and lower direction. Note that, the hinges 40 may be arranged on a back side of the main body case 20 and the cover body 30 for the purpose of preventing the hinges from being seen from the outside when the opening portions are closed by upwardly pivoting the cover body 30. Also their structures are not especially limited.

Further, by upwardly pivoting the cover body 30, the lower end surface 33*a*, the inner end surfaces 33*b* and 33*b*, the oblique end surfaces 33*c* and 33*c* of the cover body 30 come into contact with the upper end surface 28*a*, the inner end surfaces 28*b* and 28*b*, and the oblique end surfaces 28*c* and 28*c* of the main body case 20, respectively. In this way, the both opening portions 26 and 28 are closed. In this case, a fitting line 41 (see FIG. 1), which is formed by the end surfaces of the opening portion 28 of the parts of the side surfaces and the end surfaces of the side plate 33 held in contact with each other, forms such a shape that widths of the opening portion 28 of the parts of the side surfaces and the side plate 33 are downwardly narrower. In other words, when viewed from the opening portion 28 of the parts of the side surfaces, a fitting line 41 formed between the cover body 30 and the main body case 20 forms a shape, which is downwardly narrower, while the horizontal width linking between both sides of the fitting line 41 being downwardly narrower.

Meanwhile, by downwardly pivoting the cover body 30, the both opening portions 26 and 28 of the main body case 20 are opened. In this case, in this embodiment, when the cover body 30 is opened by downwardly pivoting the cover body 30, the bottom portion 21 of the main body case 20 and the top plate 31 of the cover body 30 are positioned so as to be substantially flush with each other. Thus, in this structure, the bottom portion 21 of the main body case 20 and the top plate 31 of the cover body 30 are allowed to be seated and placed (see FIG. 3 and FIG. 4).

Figure 4:
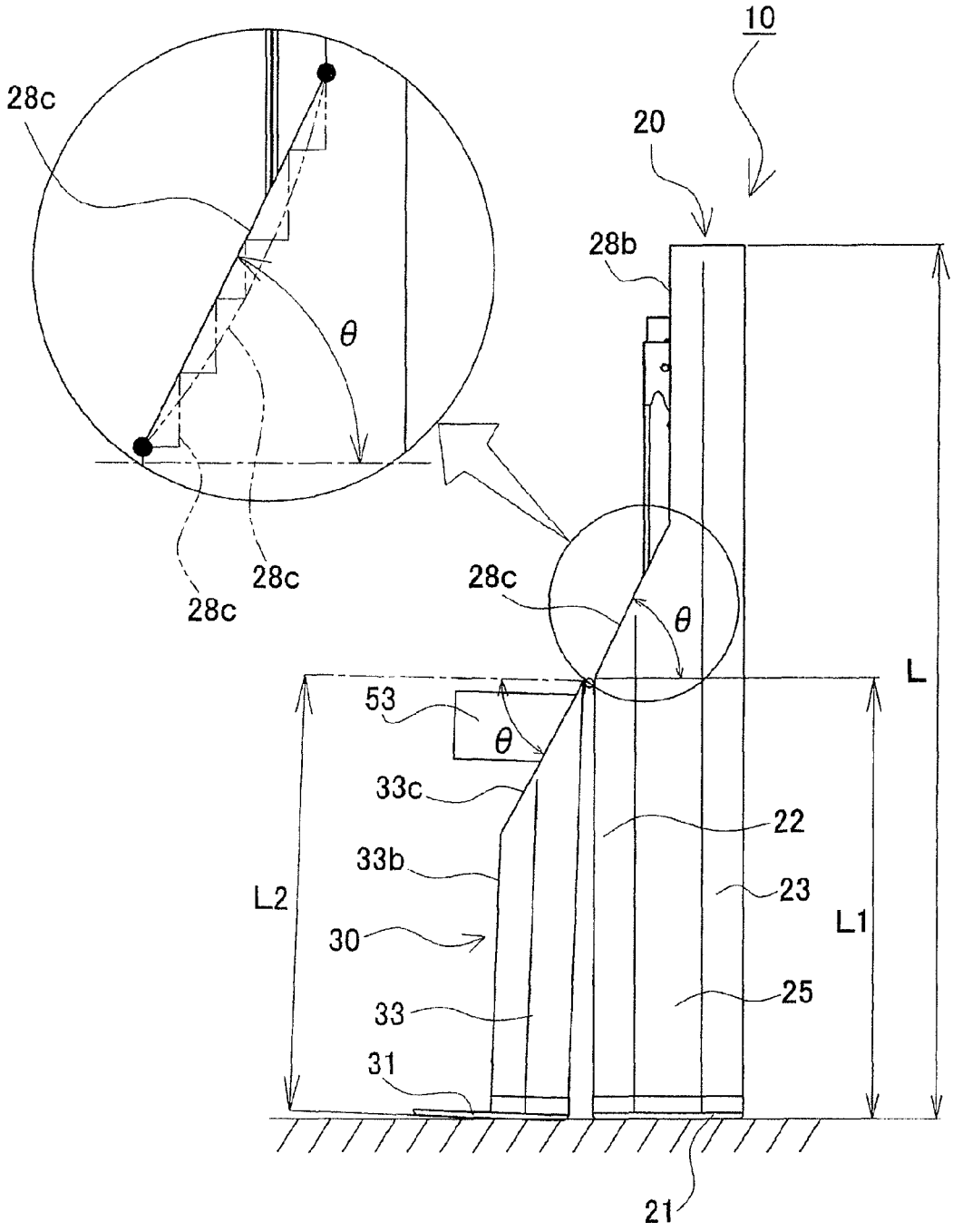
FIG. 4 is a side view illustrating the state in which the opening portions are completely opened by downwardly pivoting the cover body by approximately 180° in the instrument housing case according to the embodiment of the present invention.

In this regard, also with reference to a side view of the instrument housing case 10 of FIG. 4, in this embodiment, a length L1 ranging from the bottom portion 21 of the body case 20 up to the upper end surface 28*a* of the larger-width-wall 22 is set to be equal to a length L2 ranging from the top plate 31 of the cover body 30 up to the lower end surface 33*a* of the side plate 33. That is, due to a structure in which the instrument housing case 10 is divided into two parts having a equal length in the longitudinal direction of the instrument housing case 10 so as to cause one part of the two parts to be opened and closed, when the cover body 30 is downwardly pivoted through the hinges 40, the bottom portion 21 and the top plate 31 of the cover body 30 are positioned so as to be substantially flush with each other.

Note that, it is possible that the length L1 is set to be larger than a half of a height L of the main body case 20, the length L2 is set to be smaller than a half of the height L of the main body case 20, and a length of the opening portions in a height direction of the main body case 20 is set to be smaller. In this case, when the cover body 30 is downwardly pivoted, the top plate 31 of the cover body 30 cannot be seated. Thus, though stability of the instrument housing case 10 is slightly deteriorated upon opening of the cover body 30, there is a merit in that it is possible to increase the strength of the main body case 20.

Further, as illustrated in FIG. 4, of the end surfaces constituting the fitting line 41, an angle θ of the oblique end surface 28*c* with respect to the bottom portion 21 in the main body case 20 and an angle θ of the oblique end surface 33*c* with respect to the top plate 31 in the cover body 30 ranges preferably from 0 to 75°, and more preferably, from 45 to 70°. As the above-mentioned angles θ are smaller, the opening portion 28 of the parts of the side surfaces is larger. Therefore, in this case, it is easier to take the instrument out of the instrument housing case, but the strength of the main body case 20 tends to decrease. In contrast, as the above-mentioned angles θ are larger, the strength of the main body case 20 increases, but it is more difficult to take the instrument out of the instrument housing case. Note that, in this example, each line defining the angle θ of each of the oblique end surfaces 28*c* and 33*c* means a line linking a connecting point between each of the oblique end surfaces and the inner end surface with a connecting point between each of the oblique end surfaces and the upper end surface (in other words, lower end surface). Note that, the both connecting points are illustrated by black points. The oblique end surfaces 28*c* and 33*c* may include a zigzag surface repeating horizontal surfaces and perpendicular surfaces or a surface curved so as to have an arc shape or the like, as illustrated by imaginary lines in a partial enlarged view of FIG. 4.

By the way, as described above, in this structure, when the opening portions are closed by upwardly pivoting the cover body 30, the end surfaces of the cover body 30 and the end surface of the main body case 20 come into contact with each other, to thereby form the fitting line 41. In this case, it is preferred that in a vicinity of the fitting line 41, there are provided the following members. That is, in FIG. 5, which is a plan view of a cross-section of the fitting line between the inner end surfaces 28*b* and 28*b* of the smaller-width-walls 24 and 25 of the main body case 20 and the inner end surfaces 33*b* of the cover body 30, on each of the inner end surfaces, there are provided elastic members 41*a* and 41*b* each formed of an elastomer, a rubber, or the like. Further, a contact surface of the elastic member 41*a* provided to the inner end surfaces 28*b* and 28*b* of the main body case 20 is recessed. A contact surface of the elastic member 41*b* provided to the inner end surfaces 33*b* of the cover body 30 has a convex shape adapted for the recessed portion of the elastic member 41*a*. The above-mentioned elastic members 41*a* and 41*b* are formed in an entire periphery of the fitting line 41. Note that, in this embodiment, in FIG. 1 to FIG. 4, FIG. 6, and FIG. 7, the elastic members 41*a* and 41*b* are omitted for convenience.

Therefore, by upwardly pivoting the cover body 30, the convex portion of the elastic member 41*b* fits elastically into the recessed portion of the elastic member 41*a*. Thus, while the fitting line 41 is formed in a state in which the main body case 20 and the cover body 30 are held in close contact with each other, the both opening portions 26 and 28 of the main body case 20 are closed. As described above, while the fitting line 41 is formed in a state in which the main body case 20 and the cover body 30 are held in close contact with each other through the two elastic members 41*a* and 41*b*, the cover body 30 is closed. Thus, it is possible to further increase a sealing property of the opening portions 26 and 28. Further, it is possible to prevent the moisture and the like from getting into the instrument housing case 10 from the outside. Note that, the recessed portion may be provided to the elastic member 41*b* and the convex portion may be provided to the elastic member 41*a*. In addition, a shape of each of the elastic members is not limited to those illustrated in FIG. 5, and another structure may be employed.

Further, to the above-mentioned main body case 20 and cover body 30, there are provided fasteners 43 for locking the cover body 30 in a closed state when the opening portions are closed by upwardly pivoting the cover body 30. In this embodiment, the fasteners 43 and 43 of a male and female coupling type are provided to the fitting lines 41 and 41 on both sides in the lateral direction, on an upper side in the longitudinal direction of the instrument housing case 10, respectively (see FIG. 1 to FIG. 3 and FIG. 6). Each of the fasteners 43 includes a first metal piece 43*a* and a second metal piece 43*b*. The first metal piece 43*a* is fixedly provided in an upper limb of the inner end surface 28*b* of the main body case 20, and includes a step. The second metal piece 43*b* is fixedly provided in an upper limb of the inner end surface 33*b* of the cover body 30, and includes a tongue piece fitting into the step of the first metal piece 43*a*.

In addition, in a center portion in the longitudinal direction of the smaller-width-wall 25 of the main body case 20, there is a grip handle 44 to be gripped for carrying the instrument housing case 10 in a laid posture. In addition to the grip handle 44, at a lower part of the larger-width-wall 22 of the main body case 20 and at an upper part of the side plate 33 of the cover body 30, there is fixed a shoulder strap 45 for carrying the main body case 20 on the back of a user thereof in a state in which the longitudinal direction of the main body case 20 is oriented in the vertical direction. As illustrated in FIG. 1, in this embodiment, an upper end of the shoulder strap 45 is connected on one side (right side in FIG. 1) in the width direction, that is, in the right and left direction of the side plate 33, and a lower end of the shoulder strap 45 is connected on the other side (left side in FIG. 1) in the width direction of the larger-width-wall 22. In this way, the shoulder strap 45 is provided obliquely along the upper and lower direction of the instrument housing case 10. Note that, the shoulder strap 45 may be obliquely provided in the upper and lower parts of the larger-width-wall 23 (on opposite side to larger-width-wall 22) on a side of a back surface of the main body case 20, and is not especially limited.

As illustrated in FIG. 2 and FIG. 3, both side portions of the opposed surfaces having larger widths in the main body case 20 are connected to each other through dividing walls 47 and 47. In both side portions of an inside of the main body case 20, there are formed housing portions 48 and 48 for housing the bows 7 as accessories of the instrument. That is, both side portions in the width direction of the larger-width-walls 22 and 23 of the main body case 20 are connected to each other through the plate-like dividing walls 47 and 47. In this way, the pair of housing portions 48 and 48 in the right and left direction are formed. An upper end of each of the dividing walls 47 forms an obliquely cut shape on a side of the opening portion 28 of the parts of the side surfaces.

In association with the above-mentioned housing portions 48, in upper inner surfaces of the both smaller-width-walls 24 and 25 of the main body case 20, there are provided fixtures 49 for detachably locking the bows 7, which are housed in the housing portions 48, to the inner surfaces of the instrument housing case. With reference to FIG. 2, FIG. 3, FIG. 6, and FIG. 7, each of the fixtures 49 includes a plate-like base portion 49*a* and a plate-like rotary clamp portion 49*b* (see FIG. 6). The plate-like base portion 49*a* is fixedly provided in the inner surface of each of the smaller-width-walls 24 and 25. The plate-like rotary clamp portion 49*b* is rotatably fixed with respect to the base portion 49*a*. Further, in a normal state, the rotary clamp portion 49*b* remains being rotated in the same direction with respect to the base portion 49*a*. In order to retain each of the bows 7 housed in the housing portion 48, after the rotary clamp portion 49*b* is sandwiched between the stick 7*a* and the bow hair 76 of the bow 7, the rotary clamp portion 49*b* is rotated by 90° with respect to the base portion 49*a*. In this way, the bow 7 can be locked and retained (see FIG. 7).

The above-mentioned main body case 20 and cover body 30 are formed of a thermosetting resin such as an epoxy resin, an unsaturated polyester resin, a vinyl ester resin, and a polyimide resin, or a thermoplastic resin such as a polyethylene, a polypropylen, a polytetrafluoroethylene, a polycarbonate, an acrylic resin, a nylon, and an acrylonitrile-butadiene-styrene (ABS) resin. In this case, the above-mentioned main body case 20 and cover body 30 are preferably formed of a resin reinforced with reinforced fiber, and more preferably, of a resin reinforced with woven fabric containing carbon fiber. By using the above-mentioned fiber reinforced resin, it is possible to provide the instrument housing case 10 having light weight and high stiffness.

It is possible to preferably house, in the instrument housing case 10 having the above-mentioned structure, the instrument 1 as the rubbed string instrument including the main body portion 2, the neck 3, the fingerboard 4, the bridge portion 8, the chinrest 6, and the like illustrated in FIG. 8 as described above. The above-mentioned instrument 1 is applied with multi-layer paint such as varnish and a polyurethane for the purpose of improving an acoustic property of the instrument 1 and protecting the instrument 1 from the moisture. The above-mentioned paint takes at least several months to be completely dried. During a time period until the paint is completely dried, it is desired to house the instrument 1 in the instrument housing case 10 so that other members do not come into contact with painted surfaces.

In order to solve the above-mentioned problem, in the instrument housing case 10 according to this embodiment, the following structure is employed. That is, as illustrated in FIG. 2, FIG. 3, FIG. 6, and FIG. 7, in a center of an inner surface of the bottom portion 21 of the main body case 20, there is provided a first retaining portion 50 for supporting a vicinity of end pins 5 of the instrument 1. In an upper surface of the first retaining portion 50, there are formed groove portions 50*a*, into which the end pins 5 of the instrument 1 are received, respectively (see FIG. 6). As illustrated in FIG. 7, the vicinity of the end pins 5 of the instrument 1 is supported by the first retaining portion 50.

Figure 6:
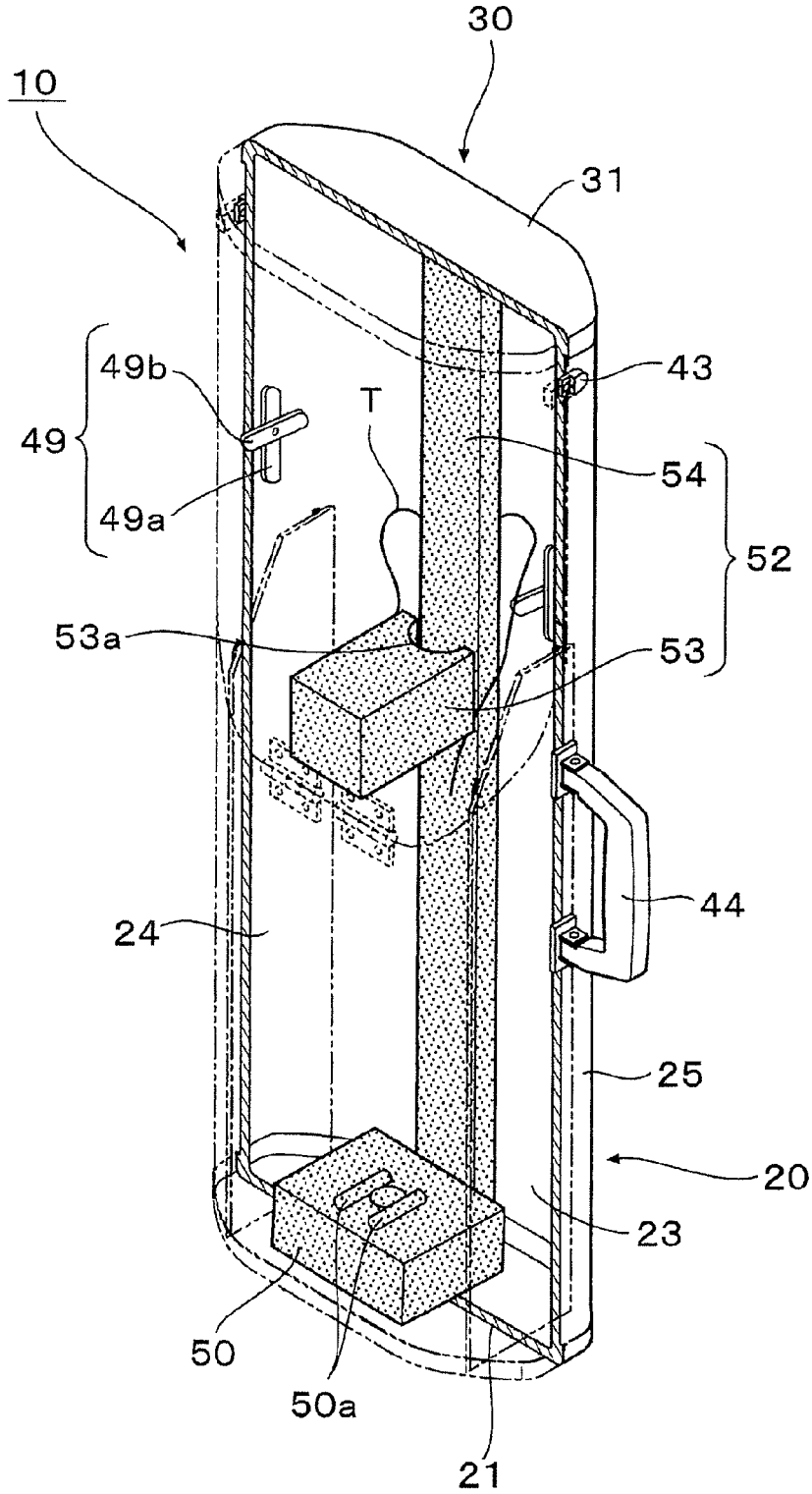
FIG. 6 is a perspective cross-sectional view illustrating a state in which the opening portions are closed by upwardly pivoting the cover body in the instrument housing case according to the embodiment of the present invention.
Figure 7:
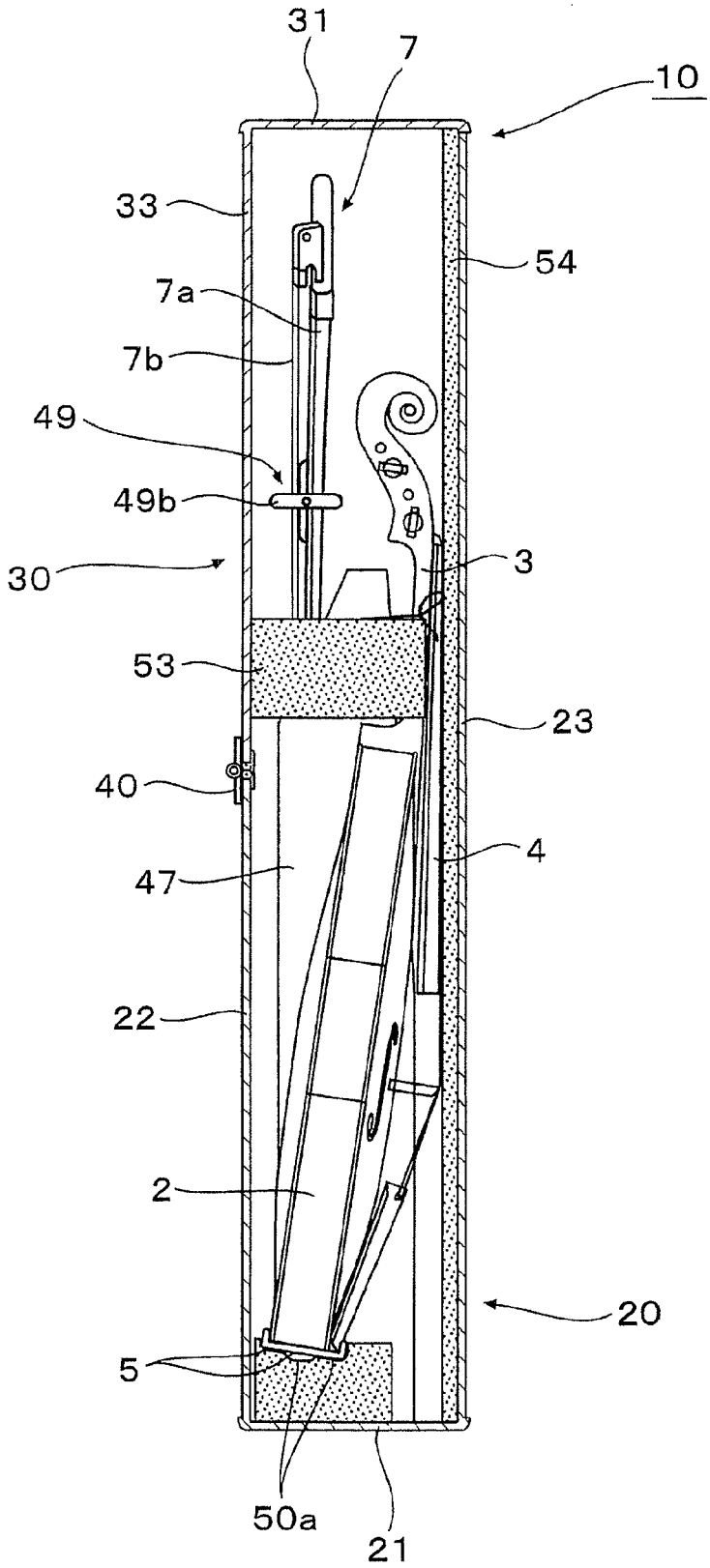
FIG. 7 is a side cross-sectional view illustrating the state in which the opening portions are closed by upwardly pivoting the cover body in the instrument housing case according to the embodiment of the present invention.

In addition, as illustrated in FIG. 6, on an inner surface of the main body case 20 opposed to the side plate 33 of the cover body 30 and on an inner surface of the side plate 33 of the cover body 30, there is provided a second retaining portion 52 for sandwiching the neck 3 of the instrument 1. The second retaining portion 52 includes a first holding member 53 and a second holding member 54. The first holding member 53 is fixed on the inner surface of the side plate 33 of the cover body 30, and holds a back surface portion of the neck 3 of the instrument 1. The second holding member 54 is fixed on the inner surface of the main body case 20, and the fingerboard 4, which is provided on a front side of the neck 3 of the instrument 1, comes into contact with the second holding member 54. The fingerboard 4 is supported in substantially parallel to the inner surface of the main body case 20. The first holding member 53 is fixedly provided on the inner surface, in the center in the width direction on a side of the lower end, of the side plate 33 of the cover body 30. In a protruding end surface of the first holding member 53, there is formed a holding groove portion 53*a*, which is corresponding to the shape of the neck 3 (see FIG. 6). In addition, the second holding member 54 forms a plate shape extending along the longitudinal direction in the center in the width direction of the larger-width-wall 23 of the main body case 20 (see FIG. 6).

Further, the instrument 1 is housed and retained in the instrument housing case 10 as follows. Specifically, the bottom portion of the instrument 1 is supported by the first retaining portion 50 and the neck 3 of the instrument 1 is sandwiched by the second retaining portion 52 including the first holding member 53 and the second holding member 54 (see FIG. 7). The above-mentioned process is performed in such a manner that an area in which the painted surface of the instrument 1 is held in contact with the inner surface of the instrument housing case 10 is preferably 10% or less of the entire painted surface, and more preferably, 3% or less. Further, each of the retaining portions 50 and 52 is formed of a soft material having cushioning characteristics such as polyurethane foam.

Next, a using method and action effects for the instrument housing case 10 structured as described above according to the present invention are described.

In order to house the instrument 1 in the instrument housing case 10, the bottom portion 21 of the main body case 20 is placed at a predetermined position, and the cover body 30 is downwardly pivoted in a state in which the longitudinal direction of the instrument housing case is oriented in the vertical direction so as to open the opening portion 26 of the upper end surface and the opening portion 28 of the parts of the side surfaces (see FIG. 2 and FIG. 3).

Further, the bows 7 as accessories of the instrument 1 are inserted into the housing portions 48 and 48 defined by the dividing walls 47 in the both side portions of the main body case 20, respectively. After the rotary clamp portion 49*b* of the fixture 49 is sandwiched between the stick 7*a* and the bow hair 7*b* of each of the bows 7, the rotary clamp portion 49*b* is rotated by 90° with respect to the base portion 49*a*. In this way, the bow 7 is locked and retained (see FIG. 7). As described above, it is possible to house the bows 7 as accessories of the rubbed string instrument such as a violin in the housing portions 48 defined by the dividing walls 47, respectively. Thus, it is possible to increase a convenience upon carrying and to increase the stiffness of the main body case 20 due to the dividing walls 47.

After that, the instrument 1 is inserted into the main body case 20 through the both opened opening portions 26 and 28 so that a side of the bottom portion of the instrument 1 is first inserted therein. In this time, the end pins 5 of the bottom portion of the instrument 1 are inserted into the groove portions 50*a*, respectively, so that the vicinity of the end pins is supported by the first retaining portion 50. At the same time, the fingerboard 4 of the instrument 1 is caused to come into contact with the plate-like second holding member 54, and an outer periphery of the fingerboard 4 and the neck 3 is lightly tied with a fixing thread T (see FIG. 6) provided on an upper side of the second holding member 54 so as to temporally lock the neck 3.

Figure 5:
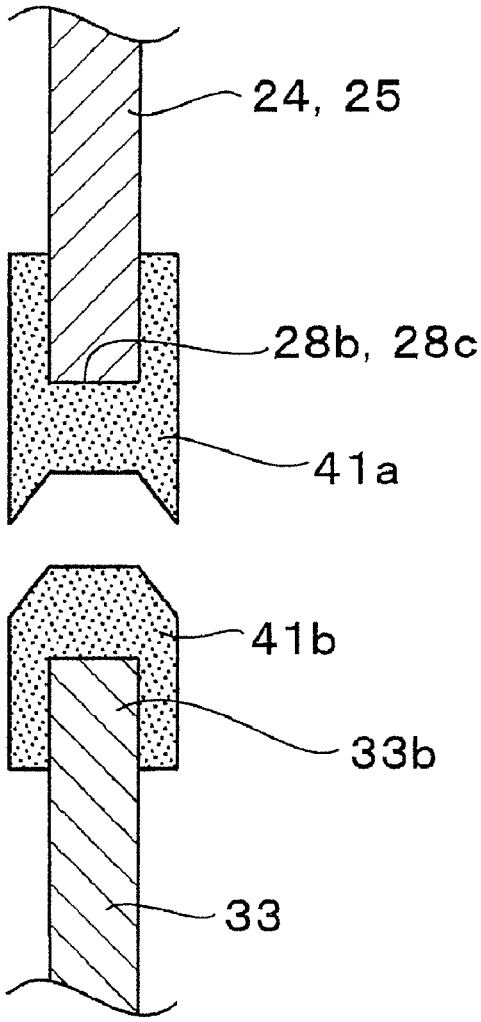
FIG. 5 is a partially enlarged explanation view illustrating a vicinity of a fitting line of the instrument housing case according to the embodiment of the present invention.

Next, the cover body 30 is upwardly pivoted. Then, the elastic members 41*a* and 41*b*, which are respectively provided on the end surfaces of the main body case 20 and the cover body 30 illustrated in FIG. 5, are caused to fit into each other, and the end surfaces 28*a*, 28*b*, and 28*c* of the main body case 20 are caused to come into contact with the end surfaces 33*a*, 33*b*, and 33*c* of the cover body 30, indirectly. As a result, the fitting line 41 is closed, to thereby close the both opening portions 26 and 28. In this time, the holding groove portion 53*a* of the first holding member 53, which is provided in the center of the inner surface of the side plate 33 of the cover body 30, comes into contact with the back surface portion of the neck 3 of the instrument 1 so as to be held by the back surface portion. Thus, also due to the second holding member 54 holding the fingerboard 4 on the front surface side of the neck 3, the neck 3 is sandwiched by the second retaining portion 52. In this way, as illustrated in FIG. 7, the instrument 1 is housed and retained in the instrument housing case 10 by the first retaining portion 50 and the second retaining portion 52. In this case, in this embodiment, the area in which the painted surface of the instrument 1 is held in contact with the inner surface of the instrument housing case 10 is set to be 10% or less of the entire painted surface.

The instrument 1 is retained by the first retaining portion 50 and the second retaining portion 52. The first retaining portion 50 causes the end pins 5 to fit therein so as to be supported. The second retaining portion 52 sandwiches the neck 3. Thus, the painted surface of the instrument 1 is held without or in less contact with the inner surface of the instrument housing case as possible. As a result, it is possible to prevent the painted surface from being damaged and from having marks generated due to adhesion of a cushion member.

Further, the second retaining portion 52 includes the first holding member 53 and the second holding member 54. The first holding member 53 holds the back surface portion of the neck 3. The fingerboard 4 on the front side of the neck 3 comes into contact with the second holding member 54. The fingerboard 4 is supported in substantially parallel to the inner surface of the main body case 20. Thus, the back surface portion (not painted portion) of the neck 3 is held by the first holding member 53 and the fingerboard 4 (portion formed of material resistant to damages and marks) is held by the second holding member 54. Thus, it is possible to retain the instrument 1 in a state in which the painted surface thereof is not held in contact with any part. Further, the fingerboard 4 is supported in substantially parallel to the inner surface of the main body case 20, and hence it is possible to efficiently house the instrument 1 in the instrument housing case 10 due to a decrease in an unnecessary space, and to retain more stably the instrument 1 in the instrument housing case 10.

In addition, as illustrated in FIG. 7, in a state in which the instrument 1 is housed and retained in the instrument housing case, the back surface portion of the neck 3 of the instrument 1 is held by the first holding member 53 and the fingerboard 4 on the front side of the neck 3 is caused to come into contact with the second holding member 54. Thus, a front side of the strings 4*a*, which are tensioned on the front side of the neck, comes into contact with the second holding member 54, elastically. Therefore, for example, even when impacts and oscillation act from the outside of the instrument housing case, those impacts and oscillation are absorbed due to elastic force of the strings 4*a* held in contact with the second holding member 54. Thus, it is possible to suppress unfavorable effects provided to the main body portion 2 and the like of the instrument 1 by a maximum degree.

Further, with regard to the instrument housing case 10 in this embodiment, a pair of opposed surfaces (larger-width-walls 22 and 23) have larger widths, and opposed surfaces (smaller-width-walls 24 and 25), which are orthogonal to the pair of opposed surfaces, have smaller widths. In this way, the instrument housing case 10 forms a generally flat shape. Further, the opening portion 28 of the parts of the side surfaces is formed over one surface having a larger width (larger-width-wall 22) and over both side surfaces (smaller-width-walls 24 and 25), which are adjacent to the one surface having the larger width. As a result, it is possible to increase the opening width formed of the both opening portions 26 and 28 as possible without deteriorating the stiffness of the main body case 20, to thereby readily take the instrument 1 in and out of the instrument housing case. Further, the side plate 33 of the cover body 30 forms a shape in which the opening portion 26 of the upper end surface of the main body case 20 and the opening portion (that is, opening portion 28 of parts of side surfaces) are covered, the opening portion 28 being formed in the larger-width-surface of the main body case 20 and in the both side surfaces adjacent to the larger-width-surface. Thus, it is possible to increase the stiffness of the cover body 30.

In addition, in the instrument housing case 10 in this embodiment, the fitting line 41 between the side surfaces of the main body case 20 and the side plate 33 of the cover body 30, forms such a shape that widths of the opening portion 28 of the parts of the side surfaces and the side plate 33 are downwardly narrower (see FIG. 2 and FIG. 3). That is, when viewed from the opening portion 28 of the parts of the side surfaces, a fitting line 41 formed between the cover body 30 and the main body case 20 forms a shape, which is downwardly narrower, while the horizontal width linking between both sides of the fitting line 41 being downwardly narrower. As described above, the width of the opening portion 28 of the parts of the side surfaces of the main body case 20 is set so as to be downwardly narrower, and hence it is possible to increase the stiffness of the main body case 20 as possible. Further, it is possible to increase the strength of fixing portion for the grip handle upon fixing, in the substantially center in the longitudinal direction of the main body case 20, the grip handle 44 to be gripped for carrying the instrument housing case 10 in the laid posture.

Figure 9:
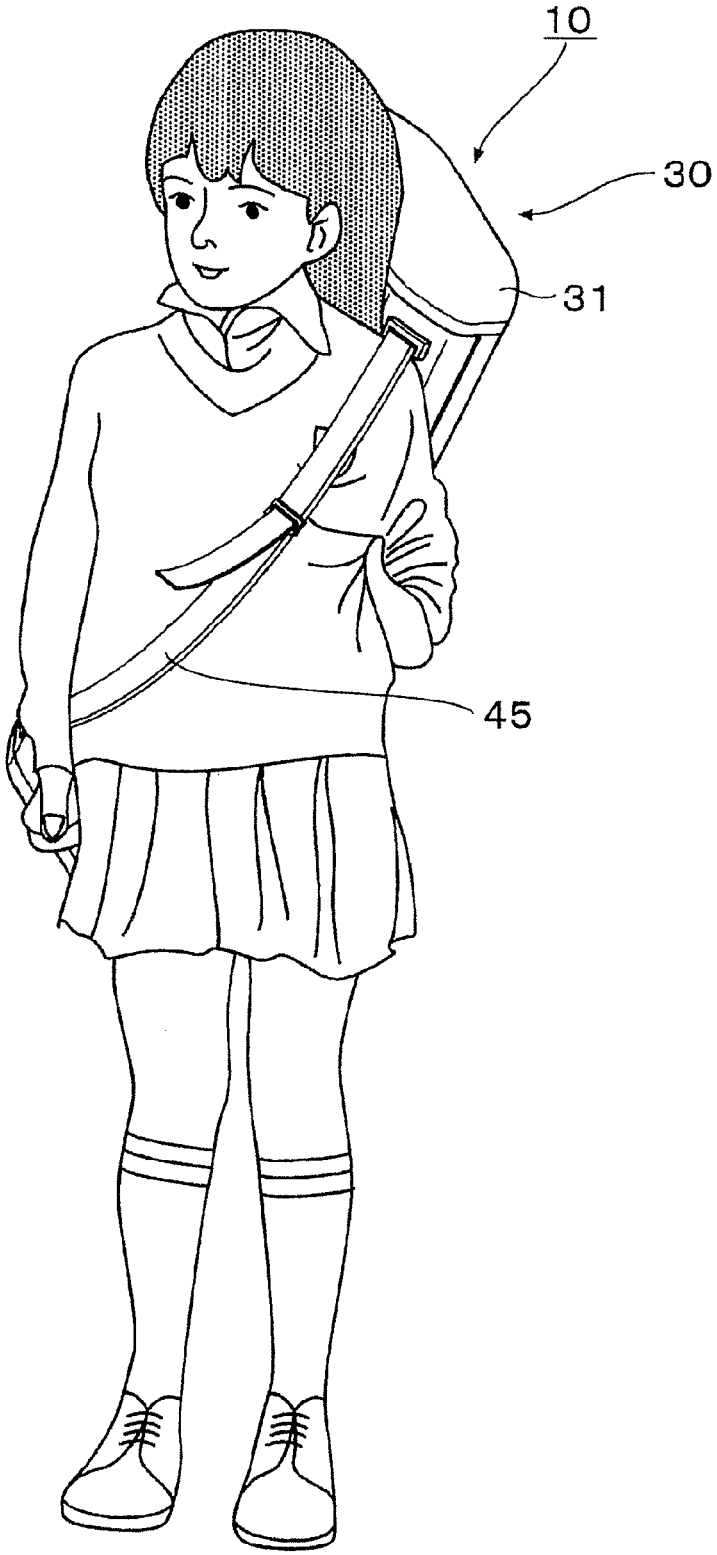
FIG. 9 is an explanation view illustrating one example upon carrying the instrument housing case according to the embodiment of the present invention.

As described above, after the both opening portions 26 and 28 are closed by upwardly pivoting the cover body 30, the first metal pieces 43*a* on the main body case 20 and the second metal pieces 43*b* on the cover body 30 are caused to fit into each other, respectively. In this way, the cover body 30 is locked in the closed state by the fasteners 43. As a result, the cover body 30 is retained so as not to be opened with respect to the main body case 20, and hence it is possible to carry the instrument housing case 10 in the laid posture while gripping the grip handle 44. Alternatively, as illustrated in FIG. 9, it is possible that a user carries the instrument housing case 10 on his or her back with the shoulder strap 45 slung over his or her shoulder in a state in which the longitudinal direction of the instrument housing case 10 is oriented in the vertical direction.

As described above, in the instrument housing case 10 in this embodiment, two kinds of carrying styles are appropriately employed. That is, it is possible not only to carry the instrument housing case 10 in the laid posture while gripping the grip handle 44 of the main body case 20, but also to retain the instrument housing case 10 remaining arranged in the upright posture by slinging the shoulder strap 45 over the shoulder of a user. Thus, it is possible to increase the convenience for a user. When the instrument housing case 10 remaining arranged in the upright posture is retained, the top plate 31 of the cover body 30 is upwardly oriented, and hence it is possible to prevent rain water and the like from readily getting into the instrument housing case.

Further, in order to take the instrument 1 out of the instrument housing case 10, the bottom portion 21 of the main body case 20 is first placed at a predetermined position. After that, locking of the fasteners 43 is released, and the cover body 30 is opened in the longitudinal direction thereof by downwardly pivoting the cover body 30. As a result, as illustrated in FIG. 2 and FIG. 3, the both opening portions 26 and 28 of the main body case 20 are opened and the bottom portion 21 of the main body case 20 and the top plate 31 of the cover body 30 are allowed to be seated and placed (see FIG. 3 and FIG. 4).

Therefore, in this state, after the fixing thread T is untied, it is possible to take the instrument 1 out of the main body case 20 by gripping and lifting up the neck 3 or an upper part of the main body portion 2 of the instrument 1. Further, upon housing the instrument 1 in the instrument housing case 10 after playing, the bottom portion of the instrument 1 is first housed therein as described above.

As described above, in the instrument housing case 10 in this embodiment, it is possible to take the instrument 1 in and out of the instrument housing case in a state in which the instrument housing case is placed while the longitudinal direction of the instrument housing case is oriented in the vertical direction. Thus, it is possible to take the instrument 1 in and out of the instrument housing case without requiring a user to take a difficult position even in a place having a limited space for dealing with the instrument, such as a concert hall. Further, the bottom portion of the main body case and the top plate of the cover body are allowed to be seated and placed. Thus, upon taking the instrument 1 in and out of the instrument housing case, it is possible to stably support the instrument housing case 10.

In addition, in the instrument housing case 10 in this embodiment, the cover body 30 can be opened in the longitudinal direction with respect to the both opening portions 26 and 28 of the main body case 20 as described above. Thus, it is possible to decrease in risk in that the instrument 1 falls out of the instrument housing case 10 even in a case where the instrument housing case 10 is lifted up in a state in which the cover body 30 is not locked in the closed state with the fasteners 43 being left unlocked, or even in a case where the fasteners 43 are forced to be unlocked due to external force during conveyance.

In addition, the main body case 20 has a cylindrical shape in a part below the opening portions thereof. Thus, it is possible to increase the strength and stiffness of the main body case 20, and sufficient strength can be obtained even when the main body case 20 is decreased in wall thickness and the like. Therefore, it is possible to reduce the weight of the instrument housing case 10.

Note that, the instrument housing case 10 in this embodiment is, as described above, characterized in that it is possible to take the instrument 1 in and out of the instrument housing case in a state in which the instrument housing case 10 is placed while the longitudinal direction of the instrument housing case is oriented in the vertical direction. However, it is needless to say that, in a place having a large space for dealing with the instrument, the cover body 30 may be opened and the instrument 1 may be taken in and out of the instrument housing case in a state in which the instrument housing case 10 is laid. When the instrument 1 is taken in and out of the instrument housing case in a state in which the instrument housing case 10 is laid, it is possible to more stably perform the work.

In FIG. 10 to FIG. 14, an instrument housing case 10*a* according to another embodiment of the present invention is illustrated. Note that, parts substantially identical to those of the above-mentioned embodiment are denoted by the same reference symbols, and the description thereof is omitted.

The instrument housing case 10*a* in this embodiment includes, as in the above-mentioned embodiment, a main body case 20*a* and a cover body 30*a*. The main body case 20*a* has a bottomed cylindrical shape. The cover body 30*a* is pivotably fixed to the main body case 20*a* through hinges 40.

Figure 10A:
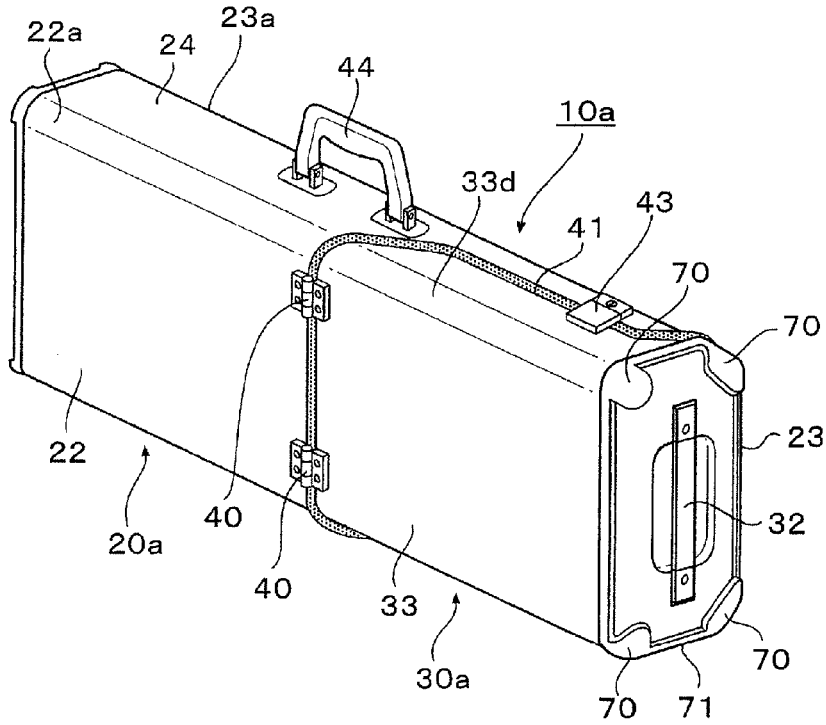
FIG. 10A is a perspective view of the other embodiment of the instrument housing case of the present invention.
Figure 10B:
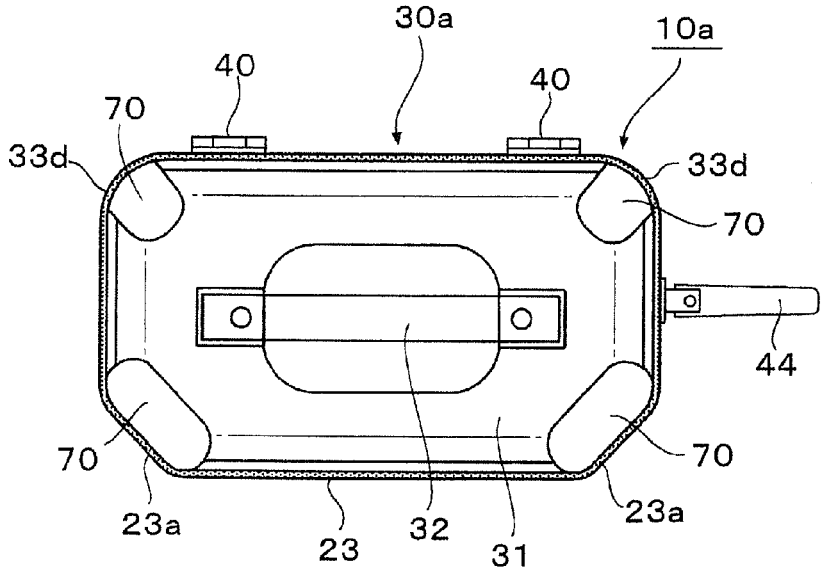
FIG. 10B is a plan view of the other embodiment of the instrument housing case of the present invention.
Figure 11:
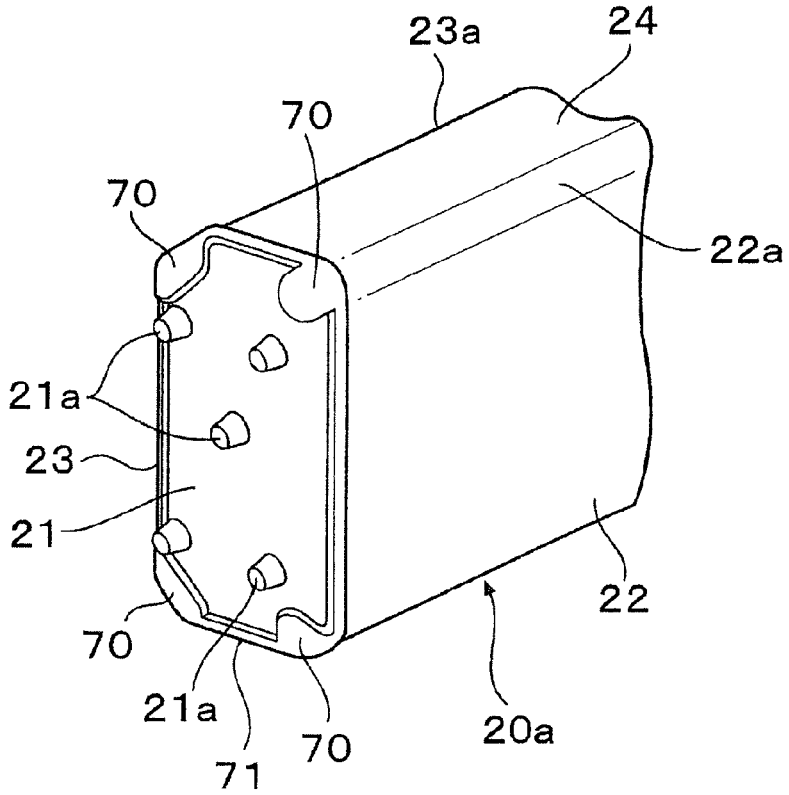
FIG. 11 is a bottom view of the instrument housing case according to the other embodiment of the present invention.

The instrument housing case 10 in the above-mentioned embodiment forms a longitudinal case shape of the substantially laterally long octagonal shape in its lateral cross-section. Meanwhile, the instrument housing case 10*a* in this embodiment forms a longitudinal case shape of a substantially rectangular shape in its lateral cross-section. More specifically, as illustrated in FIG. 10B and FIG. 11, the main body case 20*a* forms a shape in which both side corner portions 23*a* and 23*a* of the larger-width-wall 23 (wall portion opposed to the side plate 33 of the cover body 30*a*) are chamfered by a predetermined angle when viewed from a side of an upper end surface and a side of a lower end surface. As described above, the both side corner portions 23*a* and 23*a* of the larger-width-wall 23 of the main body case 20*a* are chamfered, and hence it is possible to reduce the weight and size of the main body case 20*a* by shaping the entire main body case 20*a* into a thin and slim shape. Meanwhile, both side corner portions 22*a* and 22*a* of the larger-width-wall 22 (wall portion on a side of the side plate 33 of the cover body 30*a*) of the main body case 20*a* and both side corner portions 33*d* and 33*d* of the side plate 33 of the cover body 30*a* form a rounded arc shape.

Further, the fitting line 41 between the cover body 30*a* and the main body case 20*a* forms the following shape. Specifically, the fitting line 41 extends downwardly from the upper end surface of the main body case 20*a* along the both side surfaces having smaller widths. Then, the fitting line 41 extends across the center portion of the one larger-width-surface. That is, the fitting line 41 forms the following shape. Specifically, the fitting line 41 extends from the upper end surface of the main body case 20*a* along the middle portions in the width direction of the both smaller-width-walls 24 and 25, downwardly (to side of bottom portion 21). Then, the fitting line 41 extends upright in a tapered manner from a front side of the middle portion in the height direction of the main body case 20*a* toward the one larger-width-wall 22. Then, the fitting line 41 extends across the middle portion in the height direction of the main body case 20*a* in the horizontal direction (in parallel to bottom portion 21) (see FIG. 10A). With the structure of the fitting line 41, it is possible to ensure the opening area of the opening portions by the maximum degree when the cover body 30*a* is opened from the main body case 20*a*. Thus, it is possible to smoothly take the instrument 1 in and out of the instrument housing case 10*a*.

Further, as in FIG. 5 in the above-mentioned embodiment, elastic members 41*c* and 41*c* formed of an elastomer, a rubber, or the like (see FIG. 14) are provided on both of the end surface of the main body case 20*a* and the end surface of the cover body 30*a*. When the opening portion 28 of the parts of the side surfaces of the main body case 20*a* is closed by the cover body 30*a*, the fitting line 41 is formed in a state in which the main body case 20*a* and the cover body 30*a* are held in close contact with each other. Thus, waterproofness is improved.

In addition, as illustrated in FIG. 11, at least in the corner portions of the bottom portion of the main body case 20*a*, there are formed protection layers 70. The protection layers 70 are formed of an elastic resin such as a urethane resin, and a fluororubber, a silicone rubber. In this case, a frame body 71 formed of an elastic resin is provided in the outer periphery of the bottom portion 21. The protection layers 70 are provided so as to extend from corner portions of the frame body 71 toward a center of the bottom portion 21. In this way, each of the corner portions of the bottom portion 21 is protected. Further, as illustrated in FIG. 10A and FIG. 10B, the frame body 71 is provided also in the outer periphery of the top plate 31 of the cover body 30*a*. The protection layers 70 are provided so as to extend from corner portions of the frame body 71. In this way, each of the corner portions of the top plate 31 is protected. With provision of the above-mentioned protection layers 70, when impact force is applied on the instrument housing case 10*a* because the instrument housing case 10*a* is fallen and something bumps into the instrument housing case 10*a*, for example, it is possible to alleviate the impact force so as to prevent the instrument housing case 10*a* from being damaged.

As illustrated in FIG. 11, a plurality of protruding portions 21*a* are provided so as to protrude from an outer surface of the bottom portion 21 of the main body case 20*a* so as to have a height larger than thicknesses of the protection layers 70 and the frame body 71. With this, it is possible to stably place the instrument housing case 10*a* upright when the instrument housing case 10*a* is disposed on a floor or the like in the upright posture (see FIG. 1 to FIG. 3 in the above-mentioned embodiment). Further, it is possible to dispose the bottom portion 21 of the main body case 20*a* above the floor or the like. Therefore, it is possible to prevent the bottom portion 21 from being dirty.

Further, as illustrated in FIG. 10A and FIG. 10B, in the center of the top plate 31 of the cover body 30*a*, there is fixed a pulling-type grip handle 32. With this, it is possible to grip the instrument housing case 10*a* in the upright posture. In addition, the fasteners 43 and 43 similar to those of the above-mentioned embodiment are provided in the fitting line 41 between the cover body 30*a* and the main body case 20*a*.

Meanwhile, an inner structure of the instrument housing case 10*a* in this embodiment is the following structure.

Figure 12:
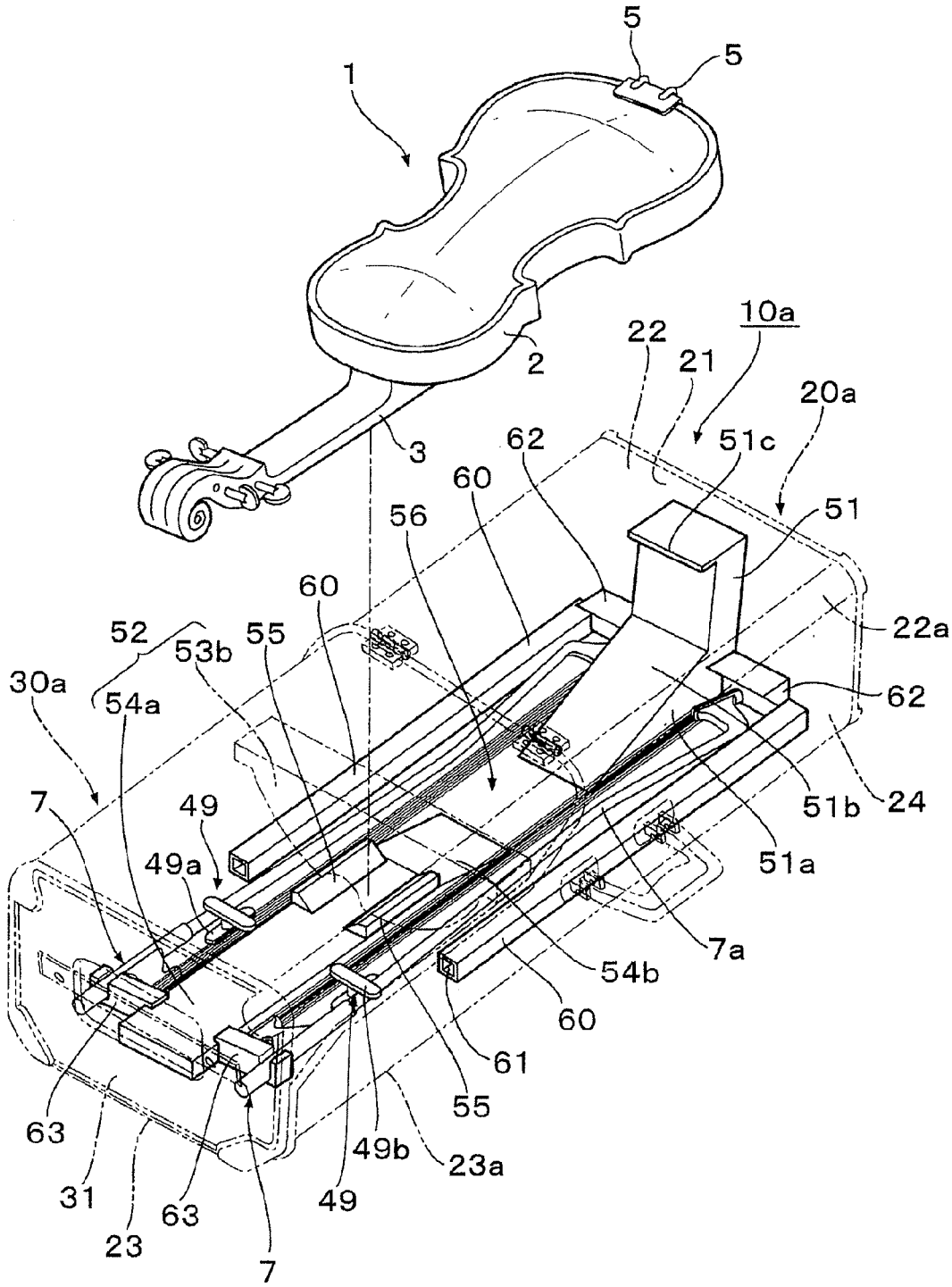
FIG. 12 is a main-part perspective view illustrating a case where the instrument housing case according to the other embodiment of the present invention is transparently viewed.
Figure 13:
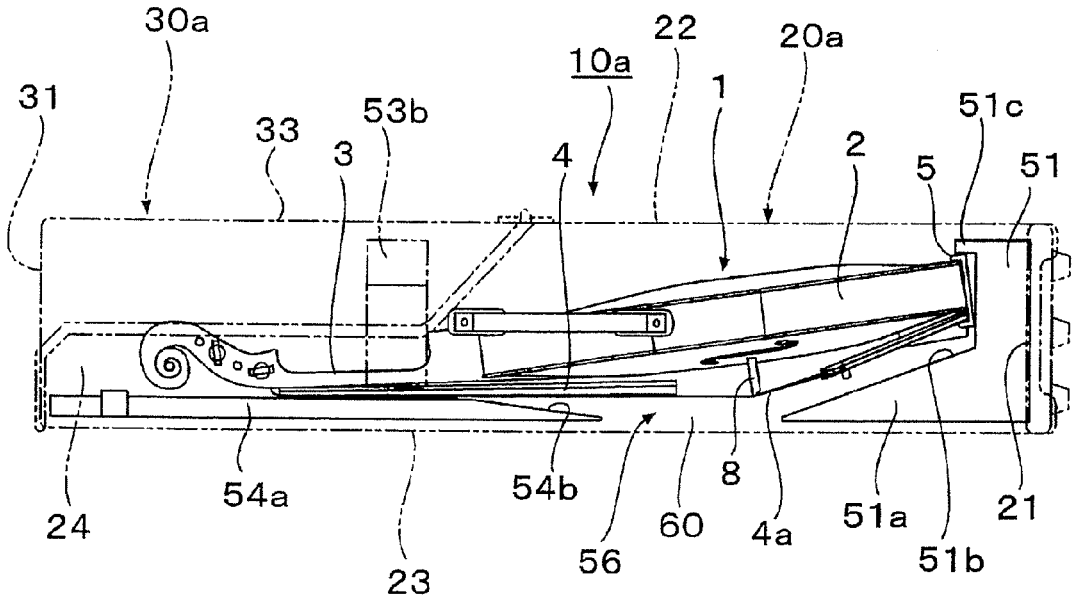
FIG. 13 is a main-part side view illustrating the case where the instrument housing case according to the other embodiment of the present invention is transparently viewed.

As illustrated in FIG. 12 and FIG. 13, in the center in the width direction of the width-larger-walls 22 and 23, of the inner surface of the bottom portion 21 of the main body case 20*a*, there is provided a first retaining portion 51 for supporting the vicinity of the end pins 5 of the instrument 1. An extending portion 51*a* extends from an end portion on a side of the width-larger-wall 23 of the first retaining portion 51 along the width-larger-wall 23 so as to extend toward above the first retaining portion 51. In an inner surface of the extending portion 51*a*, there is formed an inclined surface 51*b*. The inclined surface 51*b* protrudes toward the inside of the main body case 20*a* toward the bottom portion 21, that is, to a lower side of the main body case 20*a*, and reaches the first retaining portion 51. That is, the inclined surface 51*b* is formed above the first retaining portion 51 in the inner surface (inner surface opposed to side plate 33 of cover body 30*a*) of the width-larger-wall 23 of the main body case 20*a*, the inclined surface 51*b* protruding toward the inside of the main body case 20*a* to the lower side of the main body case 20*a*, and reaching the first retaining portion 51. Further, a rib-like engaging portion 51*c* is provided so as to protrude from the end portion on a side of the width-larger-wall 22 of the first retaining portion 51. The engaging portion 51*c* is a portion to engage with the back sides of the end pins of the instrument 1 (see FIG. 13).

Further, a second retaining portion 52 for sandwiching the neck 3 of the instrument 1 includes a first holding member 53*b* and a second holding member 54*a*. The first holding member 53*b* is fixed on the inner surface of the side plate 33 of the cover body 30*a*. The second holding member 54*a* is fixed on the inner surface of the main body case 20*a*, the inner surface being opposed to the side plate 33 of the cover body 30*a*.

The second holding member 54*a* in this embodiment extends in a plate shape in the center in the width direction of the width-larger-wall 23 of the main body case 20*a* so as to have a width identical to those of the first retaining portion 51 and the extending portion 51*a*. The second holding member 54*a* is arranged and fixed through a recessed portion 56 above the extending portion 51*a*. That is, the recessed portion 56 is formed between the first retaining portion 51 and the second retaining portion 52 in the inner surface of the width-larger-wall 23 of the main body case 20*a*. With the recessed portion 56, when the rubbed string instrument is taken in and out of the instrument housing case, or when the rubbed string instrument is housed and retained in the instrument housing case, the bridge portion 8 does not come into contact with the inner surface of the instrument housing case. Further, an end surface on the lower side of second holding member 54*a* forms a tapered surface 54*b*. With this, a contact preventing effect of the bridge portion 8 with respect to the inner surface of the instrument housing case is promoted.

In addition, a pair of neck retaining portions 55 and 55 are provided so as to protrude in a surface on the inside of the instrument housing case, in the vicinity of the tapered surface 54*b* of the second holding member 54*a*. The pair of neck retaining portions 55 and 55 retain the neck 3 of the instrument 1 from both side portions thereof upon housing in the instrument housing case. In this way, it is possible to prevent the neck 3 from being laterally offset, etc. Note that, an inner surface of each of the pair of neck retaining portions 55 forms a tapered shape. In this way, it is easy for the pair of neck retaining portions 55 and 55 to receive the neck 3 therein.

Figure 14:
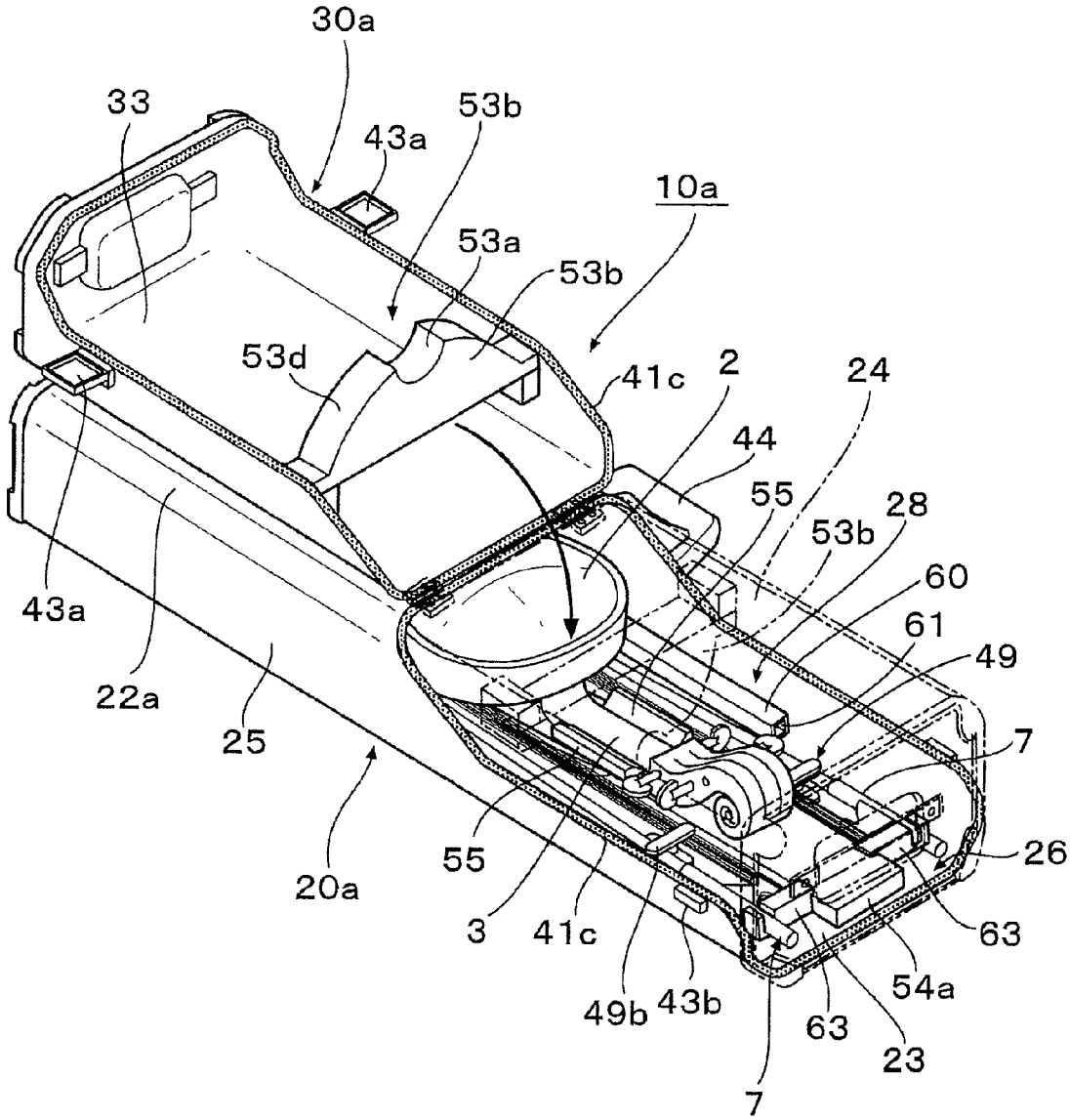
FIG. 14 is a perspective view illustrating a used state of the instrument housing case according to the other embodiment of the present invention.

Meanwhile, in the first holding member 53*b* in this embodiment, as illustrated in FIG. 14, its base portion is fixed on both sides in the width direction of the side plate 33 of the cover body 30*a*. Further, the first holding member 53*b* protrudes by a predetermined height toward the inside of the instrument housing case, and the holding groove portion 53*a* corresponding to the shape of the neck is formed in its protruding end portion. Further, both sides of the holding groove portion 53*a* form shoulder portions 53*d* and 53*d*, which are rounded like an arc. When the cover body 30*a* is closed, the first holding member 53*b* comes into contact with an edge portion, which is on a side opposite to the end pins 5, of the main body portion 2 of the instrument 1 from the side of the back surface of the instrument 1. As a result, the main body portion 2 is held against the first retaining portion 51.

As illustrated in FIG. 12, on the both side portions of the inner surface of the width-larger-wall 23 of the main body case 20*a*, there are fixed guide wall portions 60 for regulating both side positions of the bows 7. Each of the guide wall portions 60 forms a square column including a cavity 61 therein, and extends from the first retaining portion 51 up to a position slightly over a lower end of the second retaining portion 52. Between the lower end of each of the guide wall portions 60 and the both side portions of the first retaining portion 51, there are arranged bow supporting portions 62 and 62. Each of the bow supporting portions 62 and 62 is provided with a protruding portion toward the inside of the instrument housing case.

Further, on the both sides of the upper end portion of the plate-like second holding member 54*a* described above, there are fixed bow supporting portions 63 and 63. Each of the bow supporting portions 63 and 63 includes a groove portion, which is formed so as to be opened toward the inside of the instrument housing case. On a lower side of the bow supporting portions 63 and 63, there are mounted fixtures 49 similar to those of the above-mentioned embodiment so as to detachably fix the bows 7 to the inner surface of the instrument housing case. By the fixtures 49 and the above-mentioned guided wall portions 60, a bow-retaining portion according to the present invention is constituted.

Next, action effects for the instrument housing case 10*a* in this embodiment are described.

That is, the cover body 30*a* is opened with respect to the main body case 20*a*, and the instrument 1 is inserted into the instrument housing case in a state in which the back surface of the instrument 1 is oriented to a side of the opening portions so that a side of the main body portion 2 of the instrument 1 is first inserted therein. The end pins 5 of the instrument 1 is guided by the inclined surface 51*b*, which is provided above the first retaining portion 51, and moves gradually into the instrument housing case. When the instrument 1 is pushed until the end pins 5 come into contact with the first retaining portion 51, the vicinity of the end pins 5 is supported by the first retaining portion 51 in a state in which the end pins 5 of the instrument 1 is lifted up along the inclined surface 51*b* as illustrated in FIG. 13. At the same time, the neck 3 of the instrument 1 is inserted into the pair of neck retaining portions 55 and 55 on the second holding member 54*a*, and the fingerboard 4 of the instrument 1 is caused to come into contact with the plate-like second holding member 54*a*. As described above, in this embodiment, due to provision of the above-mentioned inclined surface 51*b*, the thin neck 3, which extends from the main body portion 2, is arranged substantially along the inner surface of the main body case and the end pins 5 is lifted up toward the inside of the instrument housing case with respect to the neck 3. Thus, in the above-mentioned state, it is possible to house and retain the instrument 1 in a balanced and stable posture in the instrument housing case. Further, in the above-mentioned state, the rib-like engaging portion 51*c* engages with the back side of the end pins 5 of the instrument 1. In this way, lifting up of the instrument 1 is prevented (see FIG. 13).

Further, as illustrated in FIG. 12, each of the bows 7 is inserted into the bow-retaining portion. In this time, the lower end of the bow 7 is inserted until the lower end of the bow 7 comes into contact with the bow supporting portion 62, and the upper end of the stick 7*a* of the bow 7 is caused to fit into the groove portion of the bow supporting portion 63. After that, the rotary clamp portion 49*b* of the fixture 49 is rotated by 90° with respect to the base portion 49*a*. In this way, the bow 7 can be retained in the bow-retaining portion. Note that, it is possible to house components such auxiliary strings of the bow 7 and the like in the cavity 61 of the guide wall portion 60 constituting the bow-retaining portion, which gives a convenience.

After that, as illustrated in FIG. 14, when the cover body 30*a* is closed, the neck 3 of the instrument 1 is received in the holding groove portion 53*a* of the first holding member 53*b*. Further, the both shoulder portions 53*d* and 53*d* of the first holding member 53*b* come into contact with, from the side of the back surface, the edge portion, which is on a side opposite to the end pins 5, of the main body portion 2 of the instrument 1. As a result, the main body portion 2 is pushed toward the first retaining portion 50. The opening portions of the main body case 20*a* are closed in a state in which the neck 3 is sandwiched by the first holding member 53*b* and the second holding member 54*a*. In this way, the instrument 1 is housed and retained in the instrument housing case (see FIG. 13).

As described above, the edge portion on the side opposite to the end pins 5 is inserted by being pushed toward the first retaining portion 51 by the first holding member 53*b*, and hence it is possible to readily and surely insert the instrument 1 into the case 10.

Further, in this embodiment, the recessed portion 56 for arranging the bridge portion 8 of the instrument 1 so as to prevent the bridge portion from coming into contact with the inner surface of the instrument housing case is formed between the first retaining portion 51 and the second retaining portion 52. Thus, in a state in which the instrument 1 is housed and retained in the instrument housing case, it is possible to retain the bridge portion 8 while preventing the bridge portion from coming into contact with the inner surface of the instrument housing case because the bridge portion 8 is positioned in the recessed portion 56 (see FIG. 13). Further, due to provision of the recessed portion 56, even when the instrument 1 is taken in and out of the instrument housing case 10*a*, the bridge portion 8 is not allowed to readily come into contact with the inner surface of the instrument housing case. As described above, due to provision of the recessed portion 56, when the instrument 1 is housed in the instrument housing case and when the instrument 1 is taken in and out of the instrument housing case, it is possible to prevent the bridge portion 8 from strongly coming into contact with the inside of the instrument housing case, thereby to effectively protect the bridge portion 8.

Figure 15:
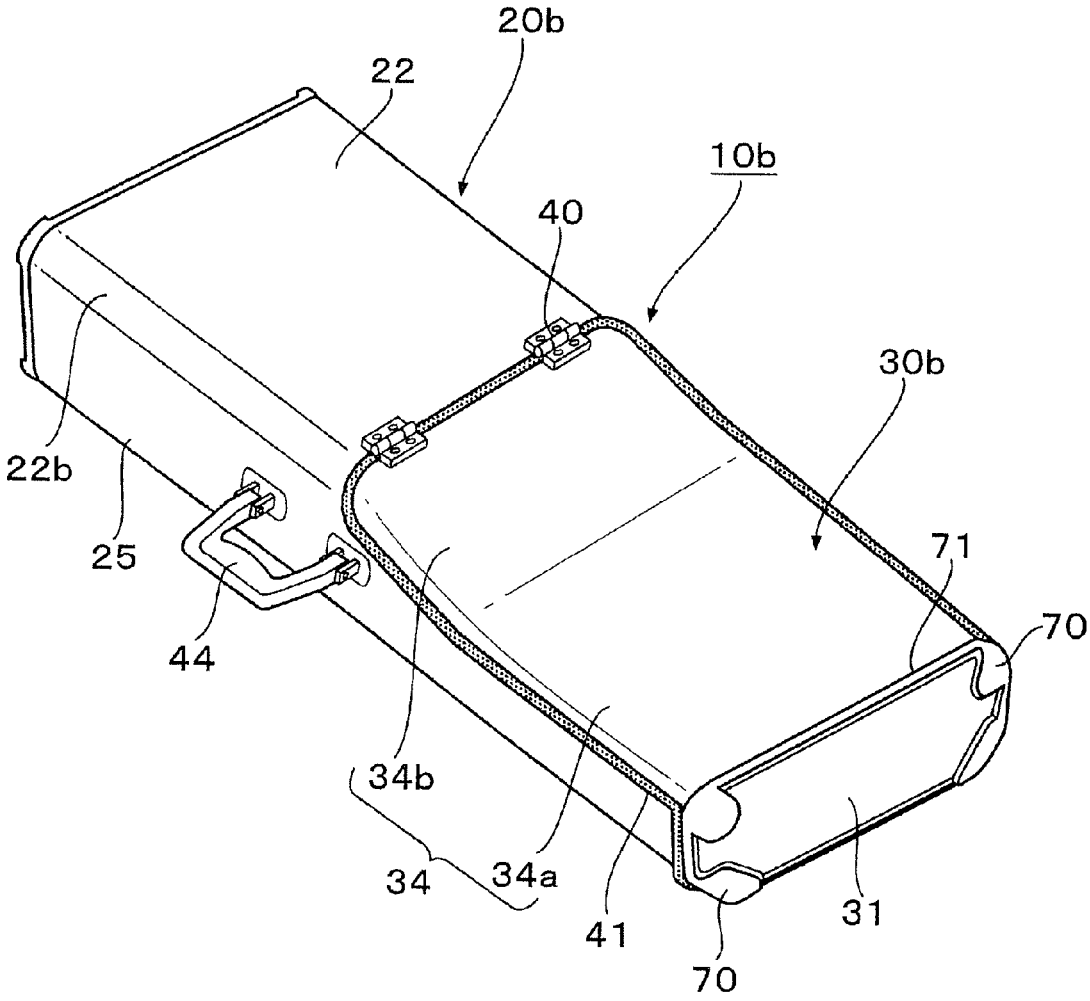
FIG. 15 is a perspective view illustrating an instrument housing case according to still another embodiment of the present invention.

In FIG. 15, an instrument housing case according to still another embodiment of the present invention is illustrated. Note that, parts substantially identical to those of the above-mentioned embodiment are denoted by the same reference symbols, and the description thereof is omitted.

In an instrument housing case 10*b* according to this embodiment, a side plate 34 of a cover body 30*b* forms a shape in which the side plate 34 of the cover body 30*b* is close to opening portions of a main body case 20*b* so as to partially decrease the thickness of the instrument housing case 10*b*. That is, the side plate 34 of the cover body 30*b* includes a flat surface 34*a* and a tapered surface 34*b*. The flat surface 34*a* extends downwardly from the upper end surface of the main body case 20*b* along the both side surfaces having smaller widths in parallel to the one larger-width-surface. The tapered surface 34*b* extends obliquely from the flat surface 34*a* toward the other larger-width-surface. In this embodiment, the instrument housing case 10*b* is formed so as to be thinner and slimmer than that in the above-mentioned embodiments. Thus, it is possible to further reduce the weight and size of the instrument housing case.

What is claimed is:

1. An instrument housing case for housing an instrument, which is long in one direction, the instrument housing case allowing the instrument to be taken in and out of the instrument housing case in a state in which the instrument housing case is placed while a longitudinal direction of the instrument housing case is oriented in a vertical direction, the instrument housing case comprising:

an integrally formed main body case, which has a bottom portion with a closed bottom, an open upper portion with a completely open top in opposition to the closed bottom, and side surfaces connected to the closed bottom, the side surfaces having partially open parts; and a cover body, including:

a top plate adapted for closing the open top of the upper portion of the main body case; and a side plate adapted for closing the partially open parts of the side surfaces, the side plate comprising a lower end portion pivotably fixed to the main body case through a hinge to allow the instrument housing case to open and close, wherein, when the cover body is opened by downwardly pivoting the cover body, the closed bottom of the main body case and the top plate of the cover body are positioned so as to be substantially flush with each other, to thereby allow the bottom of the main body case and the top plate of the cover body to be seated and placed, wherein the main body case has a pair of opposed surfaces with larger widths, and a pair of opposed surfaces, which are orthogonal to the pair of opposed surfaces having the larger widths, with smaller widths;

wherein the open upper portion and the partially open parts of the side surfaces are provided by one surface of the pair of opposed surfaces having the larger widths and both surfaces of the pair of opposed surfaces having the smaller widths, adjacent to the one surface of the pair having the larger widths;

wherein side portions of the opposed surfaces having the larger widths of the main body case are connected to each other through dividing walls;

wherein a housing portion sized and configured for housing a bow-shaped accessory of the instrument is formed in each side portion of an inside of the main body case; and wherein the hinge is situated at a side in one of the surfaces having the larger widths.

2. An instrument housing case according to claim 1, wherein, when viewed from the opening portion of the parts of the side surfaces, a fitting line is between the cover body and the main body case and extends downwardly from the top plate of the cover body and then horizontally to define the side plate of the cover body.

3. An instrument housing case according to claim 1, wherein the instrument housing case is formed of a resin reinforced with woven fabric containing carbon fiber.

4. An instrument housing case according to claim 1, wherein:

the instrument comprises a rubbed string instrument comprising:

a main body portion;

a neck extending from the main body portion;

a bridge portion arranged on a front side of the main body portion;

a string tensioned through the bridge portion on the front side of the main body portion and on a front side of the neck; and a chinrest fixed with an end pin to an end portion of the main body portion on a side opposite to the neck;

a first retaining portion for supporting a vicinity of the end pin is provided on an inner surface of the bottom portion of the main body case;

a second retaining portion for sandwiching the neck is provided on an inner surface of the main body case, which is opposed to the side plate of the cover body, and on an inner surface of the side plate of the cover body; and an area in which a painted surface of the instrument is held in contact with an inner surface of the instrument housing case is set to be 10% or less of an entire of the painted surface.

5. An instrument housing case according to claim 4, wherein:

the second retaining portion comprises:

a first holding member, which is fixed on the inner surface of the side plate of the cover body, and holds a back surface portion of the neck; and a second holding member, which is fixed on the inner surface of the main body case, and with which a fingerboard provided on the front side of the neck comes into contact; and the fingerboard is supported in substantially parallel to the inner surface of the main body case.

6. An instrument housing case according to claim 4, wherein, between the first retaining portion and the second retaining portion in the inner surface of the main body case, which is opposed to the side plate of the cover body, a recessed portion for arranging the bridge portion of the rubbed string instrument while preventing the bridge portion from coming into contact with the inner surface of the instrument housing case is formed.

7. An instrument housing case according to claim 4, wherein, in the inner surface of the main body case, which is opposed to the side plate of the cover body, an inclined surface is formed above the first retaining portion, the inclined surface protruding toward the inside of the main body case as extending toward a lower side of the main body case, so as to reach the first retaining portion.

8. An instrument housing case according to claim 5, wherein the first holding member is structured so as to come into contact with an edge portion, which is on a side opposite to the end pin of the main body portion of the instrument, from a side of a back surface of the instrument when the cover body is closed, to thereby hold the main body portion against the first retaining portion.

9. An instrument housing case according to claim 1, wherein protection layers formed of an elastic resin are formed at least in corner portions of the bottom portion of the main body case.

10. An instrument housing case according to claim 1, wherein the main body case forms a shape in which both side corner portions of a wall portion opposed to the side plate of the cover body are chamfered when viewed from a side of the upper end surface and a side of a lower end surface of the main body case.

* * * * *